US012071318B2

(12) United States Patent
Hashimoto

(10) Patent No.: US 12,071,318 B2
(45) Date of Patent: Aug. 27, 2024

(54) SHEET FEEDING APPARATUS AND IMAGE FORMING APPARATUS

(71) Applicant: Masato Hashimoto, Kanagawa (JP)

(72) Inventor: Masato Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 17/697,370

(22) Filed: Mar. 17, 2022

(65) Prior Publication Data

US 2022/0315372 A1 Oct. 6, 2022

(30) Foreign Application Priority Data

Mar. 31, 2021 (JP) ..... 2021-060759

(51) Int. Cl.
*B65H 3/68* (2006.01)
*B65H 3/12* (2006.01)
*B65H 3/48* (2006.01)

(52) U.S. Cl.
CPC ..... *B65H 3/68* (2013.01); *B65H 3/128* (2013.01); *B65H 3/48* (2013.01); *B65H 2404/693* (2013.01); *B65H 2405/11425* (2013.01); *B65H 2511/416* (2013.01)

(58) Field of Classification Search
CPC . B65H 7/02; B65H 7/06; B65H 3/128; B65H 3/34; B65H 3/48; B65H 3/54; B65H 3/66; B65H 3/68; B65H 2404/693; B65H 2405/114; B65H 2405/1142; B65H 2405/11425; B65H 2511/416
See application file for complete search history.

(56) References Cited

U.S. PATENT DOCUMENTS

2011/0221119 A1* 9/2011 Fuda ..... B65H 7/02 271/11
2012/0205856 A1* 8/2012 Onodera ..... B65H 5/38 271/145
2013/0049286 A1* 2/2013 Yamazaki ..... B65H 3/128 271/11
2015/0166280 A1 6/2015 Hino et al.
2016/0107853 A1* 4/2016 Hashimoto ..... B65H 1/14 271/97
2016/0107854 A1 4/2016 Hashimoto et al.
(Continued)

FOREIGN PATENT DOCUMENTS

JP 2006-264946 A 10/2006
JP 2006-321629 11/2006
(Continued)

OTHER PUBLICATIONS

Extended European Search Report dated Sep. 5, 2022 issued in corresponding European Appln. No. 22163234.2.

*Primary Examiner* — Prasad V Gokhale
(74) *Attorney, Agent, or Firm* — Harness, Dickey & Pierce, P.L.C.

(57) ABSTRACT

A sheet feeding apparatus includes a sheet stacker, an air blower, a float regulator, and a controller. The sheet stacker stacks sheets. The air blower blows air to the sheets. The float regulator regulates a floating position of the sheets and is movable between a float regulating position at which the float regulator regulates floating of the sheets and a retracted position. The controller transmits position information of the float regulator to a notification device.

20 Claims, 14 Drawing Sheets

(56) References Cited

U.S. PATENT DOCUMENTS

| | | | | |
|---|---|---|---|---|
| 2017/0327329 | A1 | 11/2017 | Takahashi et al. | |
| 2017/0336748 | A1 | 11/2017 | Maejima et al. | |
| 2019/0152730 | A1 | 5/2019 | Hashimoto et al. | |
| 2020/0071102 | A1* | 3/2020 | Masuda | B65H 5/228 |
| 2021/0403260 | A1* | 12/2021 | Hatakawa | B65H 3/48 |
| 2022/0081241 | A1* | 3/2022 | Maeda | B65H 1/14 |

FOREIGN PATENT DOCUMENTS

| | | | |
|---|---|---|---|
| JP | 2006-321630 | A | 11/2006 |
| JP | 2016-224697 | | 12/2016 |
| JP | 2017-211634 | | 11/2017 |
| JP | 2018-002423 | | 1/2018 |

* cited by examiner

FIG. 13

| SHEET NAME | SHEET SIZE | SHEET TYPE | COLOR | BASIS WEIGHT TYPE | PROTRUDE/ RETREAT |
|---|---|---|---|---|---|
| COMPANY A DRAWING | A3(297x420mm) | PLAIN PAPER | WHITE | TYPE 2 | PROTRUDE |
| COMPANY A FLYER | A4(210x297mm) | PLAIN PAPER | WHITE | TYPE 2 | PROTRUDE |
| COMPANY A PAMPHLET | A5(148x210mm) | PLAIN PAPER | WHITE | TYPE 2 | PROTRUDE |
| COMPANY A FOLDED PAMPHLET | B4(257x364mm) | PLAIN PAPER | WHITE | TYPE 2 | PROTRUDE |
| COMPANY A LEAFLET 1 | A6(105x148mm) | RECYCLE PAPER | GREEN | TYPE 1 | PROTRUDE |
| COMPANY A SADDLE-STITCHED BOOKLET | B5(182x257mm) | COATED PAPER | WHITE | TYPE 2 | PROTRUDE |
| COMPANY A LEAFLET 2 | B6(128x182mm) | RECYCLE PAPER | GREEN | TYPE 1 | PROTRUDE |
| COMPANY A POSTER | Ledger(11x17inch) | PLAIN PAPER | WHITE | TYPE 2 | PROTRUDE |
| COMPANY B PAMPHLET COVER | custom | PRINTED PAPER | WHITE | TYPE 5 | RETREAT |
| COMPANY B PAMPHLET | custom | PLAIN PAPER | WHITE | TYPE 2 | PROTRUDE |
| COMPANY B LEAFLET | Letter(8.5x11inch) | PLAIN PAPER | WHITE | TYPE 4 | PROTRUDE |
| COMPANY B POSTCARD | 4.2x5.5(4.2x5.5in) | PLAIN PAPER | WHITE | TYPE 5 | RETREAT |
| COMPANY C GLUE BOUND BOOKLET | Legal(8.5x14inch) | PLAIN PAPER | WHITE | TYPE 3 | PROTRUDE |
| COMPANY D LEAFLET G | A4(210x297mm) | RECYCLE PAPER | PINK | TYPE 2 | PROTRUDE |
| COMPANY D LEAFLET L | A4(210x297mm) | RECYCLE PAPER | YELLOW | TYPE 1 | PROTRUDE |
| COMPANY D FLYER G | A5(148x210mm) | PLAIN PAPER | PINK | TYPE 1 | PROTRUDE |
| COMPANY D FLYER L | A5(148x210mm) | PLAIN PAPER | YELLOW | TYPE 1 | PROTRUDE |
| COMPANY E HANDOUT 1 | B5(182x257mm) | PLAIN PAPER | BLUE | TYPE 1 | PROTRUDE |
| COMPANY E HANDOUT 2 | B5(182x257mm) | EMBOSSED PAPER | ORANGE | TYPE 4 | RETREAT |
| COMPANY E HANDOUT 3 | B5(182x257mm) | LABEL PAPER | PINK | TYPE 1 | PROTRUDE |
| COMPANY E HANDOUT 4 | B5(182x257mm) | PLAIN PAPER | GREEN | TYPE 1 | PROTRUDE |

SHEET FEEDING APPARATUS AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-060759, filed on Mar. 31, 2021, in the Japan Patent Office, the entire disclosure of which is hereby incorporated by reference herein.

BACKGROUND

Technical Field

Embodiments of the present disclosure relate to a sheet feeding apparatus and an image forming apparatus.

Related Art

A sheet feeding apparatus is known in the art that includes a sheet stacker for stacking sheets, an air blower for blowing air to the sheets, and a float regulator for regulating a floating position of the sheets. In the sheet feeding apparatus, when the air blower blows air to the sheets, the float regulator is located at a float regulating position at which the float regulator regulates floating of the sheets, and when the air blower does not blow air to the sheets, the float regulator is located at a retracted position at which the float regulator is retracted from the float regulating position.

SUMMARY

In an embodiment of the present disclosure, a sheet feeding apparatus includes a sheet stacker, an air blower, a float regulator, and a controller. The sheet stacker stacks sheets. The air blower blows air to the sheets. The float regulator regulates a floating position of the sheets and is movable between a float regulating position at which the float regulator regulates floating of the sheets and a retracted position. The controller transmits position information of the float regulator to a notification device.

In another embodiment of the present disclosure, a sheet feeding apparatus includes a sheet stacker, an air blower, a float regulator, and a driver. The sheet stacker stacks sheets. The air blower blows air to the sheets. The float regulator regulates a floating position of the sheets and is movable between a float regulating position at which the float regulator regulates floating of the sheets and a retracted position. The driver drives the float regulator such that the float regulator moves between the float regulating position at which the float regulator regulates floating of the sheets and a retracted position. The driver moves the float regulator to one of the retracted position or the float regulating position based on a type of sheets stacked on the sheet stacker.

In still another embodiment of the present disclosure, an image forming apparatus forms an image on a sheet. The image forming apparatus includes the sheet feeding apparatus that feeds the sheet.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 13 is a table illustrating settings of a float regulator set in accordance with types of sheets, according to an embodiment of the present disclosure;

Figure 1:
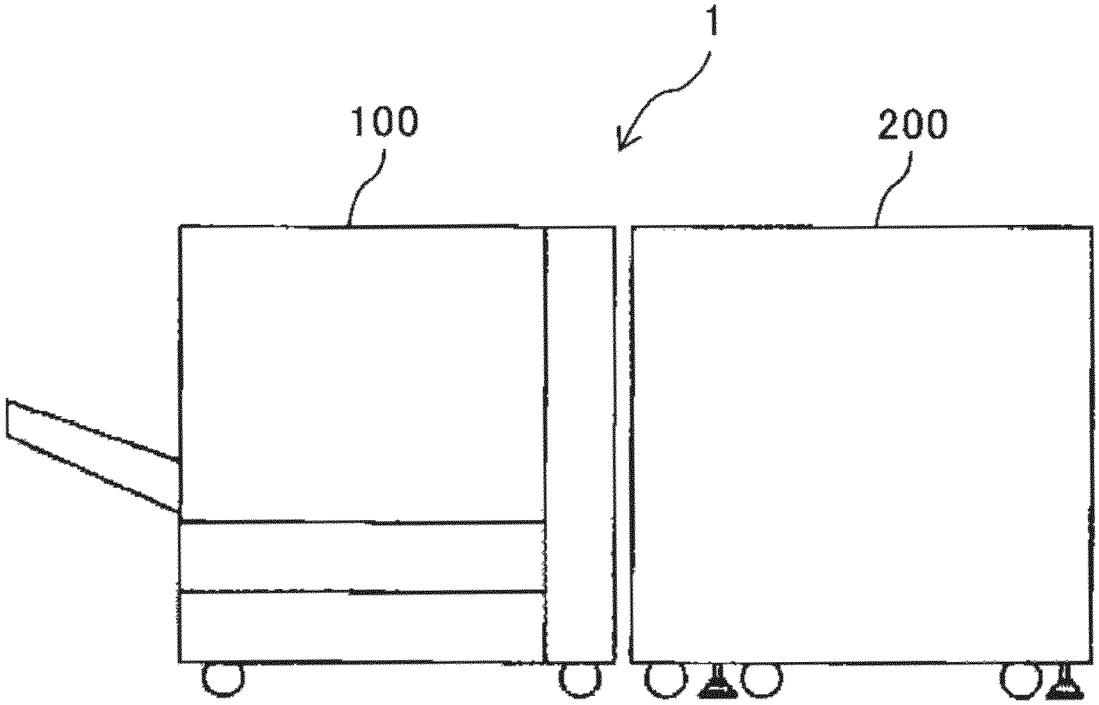
FIG. 1 is a schematic side view of an image forming apparatus including a sheet feeding apparatus, according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given of a sheet feeding apparatus according to an embodiment of the present disclosure below.

FIG. 1 is a schematic side view of an image forming apparatus 1 including a sheet feeding apparatus according to the present embodiment.

As illustrated in FIG. 1, the image forming apparatus 1 includes an image forming apparatus body 100 as an image forming device that forms an image on a sheet, and a sheet feeding apparatus 200 that feeds the sheet to the image forming apparatus body 100. The sheet feeding apparatus 200 is disposed facing a side surface of the image forming apparatus body 100.

The recording method of the image forming apparatus body 100 is not particularly limited, and any method such as an electrophotographic method and an inkjet method may be adopted. A sheet carry-in device is disposed on a right-side surface of the image forming apparatus body 100 in FIG. 1 through which a sheet is conveyed from the sheet feeding apparatus 200. The sheet carry-in device includes an opening for receiving the sheet and a conveyor for conveying the sheet.

Figure 2:
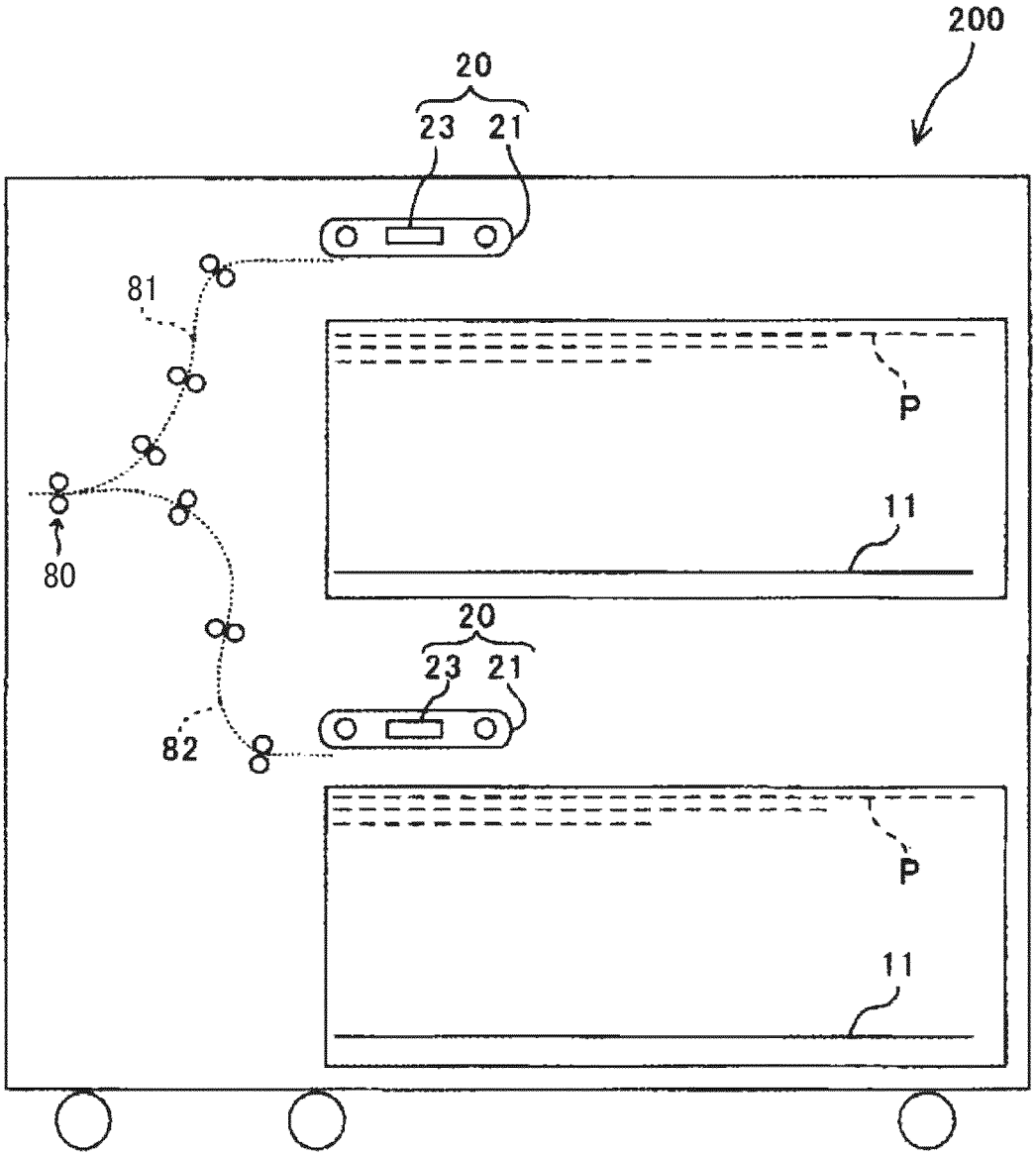
FIG. 2 is a schematic side view of the sheet feeding apparatus of FIG. 1.

FIG. 2 is a schematic side view of the sheet feeding apparatus 200 according to the present embodiment.

As illustrated in FIG. 2, the sheet feeding apparatus 200 includes upper and lower accommodating trays 10 stacked in two stages. Each of the accommodating trays 10 includes a sheet stacking table 11 as a sheet stacker on which a sheet bundle Pt is stacked. Each of the accommodating trays 10 can accommodate, for example, a maximum of about 2500 sheets P.

Examples of the sheets P accommodated in the accommodating trays 10 include sheets of paper, coated paper, label paper, overhead projector (OHP) transparencies, films, and prepregs. The prepregs are mainly used as materials for laminates and multilayer printed wiring boards. For example, a long resin base material, such as glass cloth, paper, non-woven fabric, or aramid cloth, is continuously impregnated with a resin varnish mainly composed of a thermosetting resin, such as an epoxy resin or a polyimide resin. The long resin material is heated, dried, and cut, and is thus processed into a sheet material and fabricated as a prepreg material.

A feeding unit 20 that separates and feeds the sheets P stacked in the accommodating tray 10 is disposed above each of the accommodating trays 10. Each of the feeding units 20 includes a suction belt 21 and a suction device 23 as conveyors.

The sheets P stacked in the lower accommodating tray 10 are conveyed to the image forming apparatus body 100 by an exit roller pair 80 through a lower conveyance path 82. The sheets P stacked in the upper accommodating tray 10 are conveyed to the image forming apparatus body 100 by the exit roller pair 80 through an upper conveyance path 81.

Figure 3:
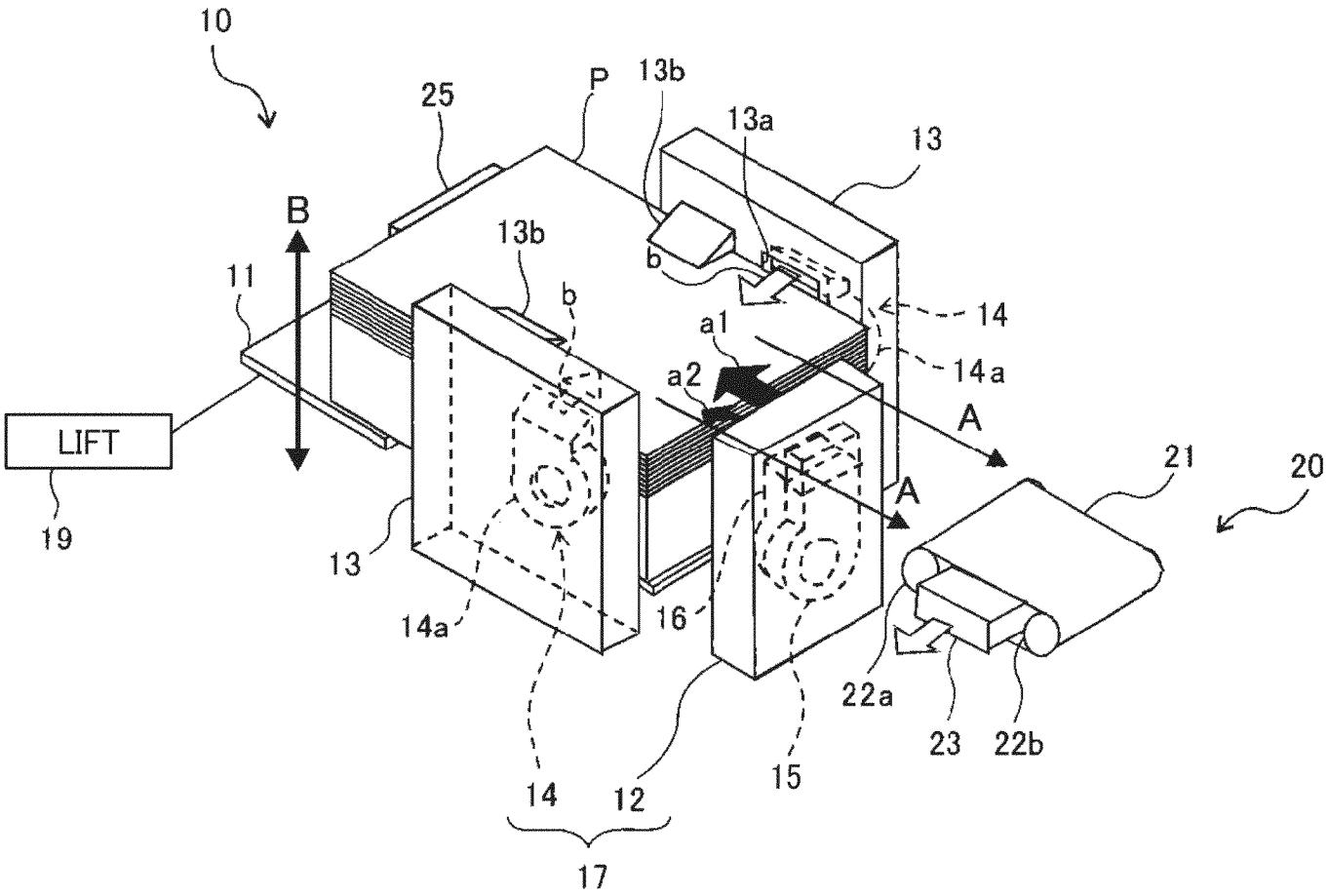
FIG. 3 is a schematic perspective view of one of accommodating trays provided for the sheet feeding apparatus of FIG. 1.

FIG. 3 is a schematic perspective view of one of the accommodating trays 10 provided for the sheet feeding apparatus 200, according to the present embodiment. In FIG. 3, the feeding unit 20 is illustrated at a position shifted from a position at which the feeding unit 20 is normally located in a direction indicated by arrows A such that the feeding unit 20 can be easily recognized. The suction belt 21 of the feeding unit 20 that serves as a feeder is stretched by two stretching rollers 22*a* and 22*b*. The suction belt 21 includes suction holes in the entire region in the circumferential direction of the suction belt 21. The suction holes penetrate the suction belt 21 from the front surface to the back surface of the suction belt 21. A suction device 23 is disposed inside the suction belt 21.

The suction device 23 is coupled to a suction fan to suck air via an air duct that is a flow passage of the air and generates a negative pressure below the feeding unit 20 to attract the sheet P onto a lower surface of the suction belt 21. The air sucked by the suction device 23 is called suction air.

Further, each of the accommodating trays 10 includes a blower 17 serving as a blower that blows air to upper sheets of the sheet bundle Pt. The blower 17 includes a front blower 12 and side blowers 14.

The front blower 12 blows air to a leading end of the upper portion of the sheet bundle Pt, i.e., a downstream end of the upper portion of the sheet bundle Pt in the sheet feeding direction. The front blower 12 includes a float nozzle, a separation nozzle, and a float nozzle. The float nozzle guides air in a direction in which the sheet bundle Pt is floated. The separation nozzle guides air into a portion between an uppermost floating sheet and a second uppermost floating sheet of the sheet bundle Pt to separate the uppermost floating sheet and the second uppermost floating sheet. The float blower 15 sends air to the float nozzle. The front blower 12 also includes a separation blower 16 for sending air to the separation nozzle.

The air blown from the float nozzle is referred to as floating air and the air blown from the separation nozzle is referred to as separation air. The floating air is blown out from a position facing the leading end of the upper portion of the sheet bundle Pt, i.e., the downstream end of the sheet bundle Pt in the sheet feeding direction in a direction indicated by arrow a1 in FIGS. 4A and 4B. Thus, the floating air is blown to the leading end of the upper portion of the sheet bundle Pt, i.e., the downstream end of the sheet bundle Pt in the sheet feeding direction. The separation air is blown out from a position facing the leading end of the upper portion of the sheet bundle Pt, i.e., the downstream end of the sheet bundle Pt in the sheet feeding direction in a direction indicated by arrow a2 in FIGS. 4A and 4B, and blown into a portion between the uppermost sheet attracted to the suction belt 21 and the second uppermost floating sheet. Blowing the separation air into the portion between the uppermost sheet and the second uppermost floating sheet allows the separation air to flow toward the upstream side in the sheet conveyance direction to separate the uppermost sheet from the second uppermost sheet.

Each of the side blowers 14 is disposed in each one of a pair of side fences 13 that regulates the position of the sheet bundle Pt in a width direction of the sheet bundle Pt (hereinafter simply referred to as the width direction) and blow air onto side surfaces of the upper portion of the sheet bundle Pt in directions indicated by arrows b in FIG. 3. Each of the side blowers 14 includes a side floatation nozzle and a side floatation blower 14*a*. The side floatation nozzle guides air in a direction in which the sheets of the sheet bundle Pt are separated and floated. The side floatation blower 14*a* sends air to the side floatation nozzle. The air blown from the side floatation nozzle in the directions indicated by arrows b in FIG. 3 is referred to as side air.

The side air is discharged from a discharge port 13*a* disposed at a position on each of the side fences 13 facing the upper portion of the sheet bundle Pt, and is blown to the side surface of the upper portion of the sheet bundle Pt. The air blown from the front blower 12 and the discharge ports 13*a* of the pair of side fences 13 cause sheets of the upper portion of the sheet bundle Pt to float.

Further, each of the side fences 13 includes a float regulator 13*b* as a sheet float regulator. Each of the float regulator 13*b* is disposed so as to protrude from the upper portion of the corresponding one of the side fences 13 toward the center of the sheet bundle Pt in the width direction. The sheet float regulators 13*b* regulate a floating sheet such that the floating sheet may not be blown off.

Further, the accommodating tray 10 includes an end fence 25 that aligns a rear end of the sheet bundle Pt stacked on the sheet stacking table 11 serving as the sheet stacker. A lift 19 as a sheet-stacking table mover moves the sheet stacking table 11 up and down in the direction indicated by arrow B in FIG. 3.

Next, a description is given of feeding operations of the sheet feeding apparatus 200.

FIGS. 4A, 4B, 4C, and 4D are diagrams illustrating a feeding operation of the sheet feeding apparatus 200 according to the present embodiment.

Figure 4A:
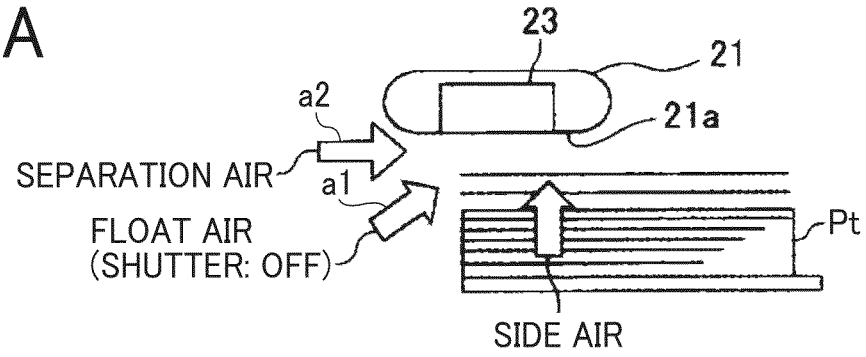
FIGS. 4A, 4B, 4C, and 4D are diagrams illustrating a sheet feeding operation of the sheet feeding apparatus of FIG. 1.
Figure 4B:
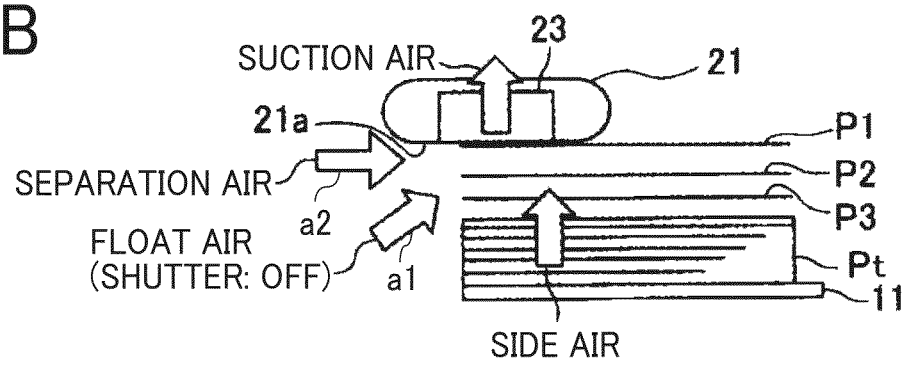
Figure 4C:
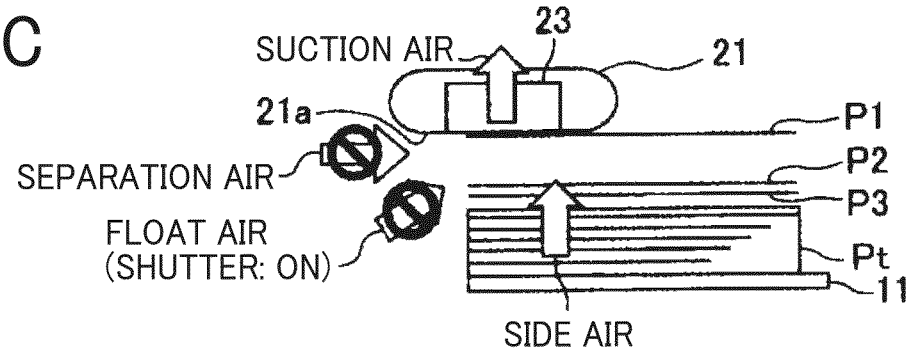
Figure 4D:
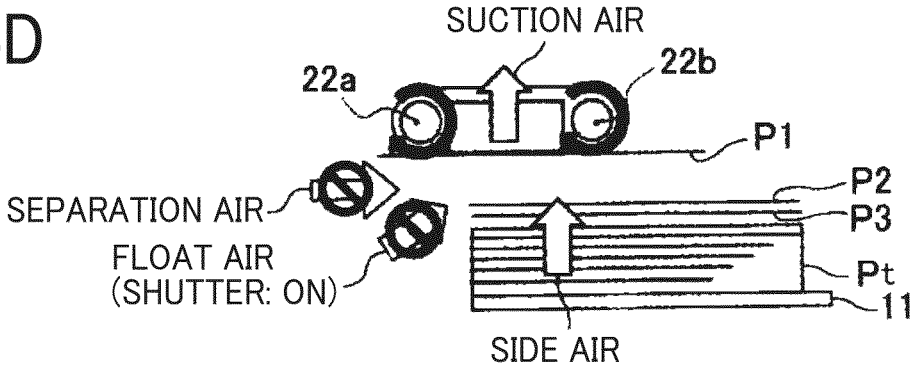

The feeding operation of the sheet feeding apparatus 200 mainly includes four processes, a floatation process illustrated in FIG. 4A, a suction process illustrated in FIG. 4B, a separation process illustrated in FIG. 4C, and a feeding process illustrated in FIG. 4D.

When the feeding operation is started, the floatation process illustrated in FIG. 4A is started. In the floatation process, air blowing by the blower 17 is started in a state in which the suction belt 21 is stopped, and floating air, separation air, and side air are blown to the sheet bundle Pt. The floating air and the side air are blown to the leading end of the upper portion of the sheet bundle Pt. Accordingly, multiple sheets of the upper portion of the sheet bundle Pt are floated, and at least an uppermost sheet among the multiple floated sheets is floated to a height at which the suction force of the suction device 23 acts.

The suction process illustrated in FIG. 4B is started at a timing at which at least the uppermost sheet among the floated sheets is floated to a height at which the suction force of the suction device 23 acts. In the suction process, suction by the suction device 23 is started when driving of the suction fan is started, and negative pressure is generated below the belt suction surface 21*a* of the suction belt 21. Then, the floated sheets are moved toward the suction belt 21 by the negative pressure. Accordingly, an uppermost sheet P1 is attracted to the belt suction surface 21*a* of the suction belt 21.

Note that, in the description illustrated in FIGS. 4A, 4B, 4C, and 4D, suction by the suction device 23 is started at a timing at which the uppermost sheet P1 is floated to the height at which the suction force of the suction device 23 acts. However, suction by the suction device 23 may be started at a timing at which air blowing by the blower 17 is started.

When the uppermost sheet P1 is attracted to the suction belt 21, the negative pressure below the belt suction surface 21*a* is eliminated. Accordingly, the separation air flows into a portion between the uppermost sheet P1 attracted to the suction belt 21 and a second uppermost sheet P2. Thus, the uppermost sheet P1 and the second uppermost sheet P2 are separated.

After the uppermost sheet P1 is attracted to the suction belt 21 as described above, the separation process illustrated in FIG. 4C is performed. In the separation process, a shutter for shutting off the floating air is turned on and moved to a position at which the shutter is closed and blowing of the floating air is stopped. Further, driving of the separation blower 16 is stopped, or a shutter for shutting off the separation air is driven to stop the blowing of the separation air. As described above, stopping the blowing of the floating air causes the floating force of the air applied to the sheets to decrease. Accordingly, the second uppermost sheet P2 and subsequent sheets drop. For this reason, a distance between the uppermost sheet P1 and the second uppermost sheet P2 attracted by the suction belt 21 is increased by a predetermined value or more. Accordingly, the uppermost sheet P1 is separated from the second uppermost sheet P2.

When the distance between the belt suction surface 21*a* of the suction belt 21 and the second uppermost sheet P2 is equal to or greater than the predetermined value, the feeding operation proceeds to the feeding process, as illustrated in FIG. 4D. In the feeding process, a feeding motor is driven to rotationally drive the suction belt 21, and the uppermost sheet P1 attracted to the suction belt 21 is fed.

Figure 5:
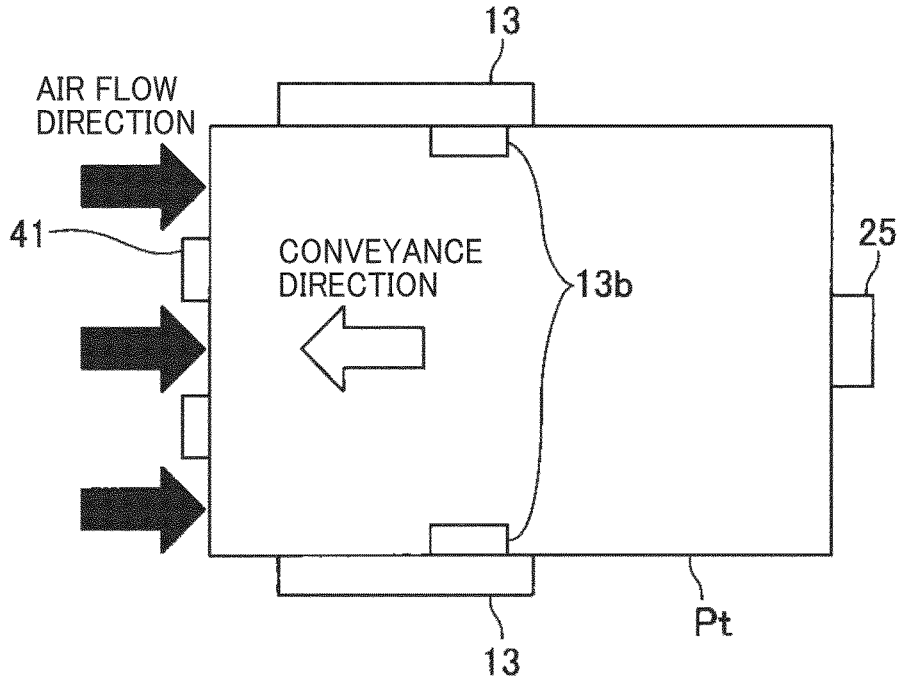
FIG. 5 is a schematic plan view of the accommodating tray of FIG. 3.

FIG. 5 is a schematic plan view of the accommodating tray 10 according to the present embodiment.

A leading end of the sheet bundle Pt is located by leading end regulating plates 41, and a trailing end of the sheet bundle Pt are located by an end fence 25. At this time, sheets of the sheet bundle Pt float by the floating air indicated by black arrows in FIG. 5 blown from the front blower 12. Each of sides of the floated sheets in the width direction contacts a corresponding one of the sheet float regulators 13*b* disposed so as to protrude from the side fence 13. Accordingly, a vertical position at which the sheets float is regulated by the sheet float regulators 13*b*.

The uppermost sheet P1 that is floated by the side air or the floating air is attracted to the suction belt 21 in a state in which each of both sides of the uppermost sheet P1 in the width direction contacts the corresponding one of the sheet float regulators 13*b*. Thus, the uppermost sheet P1 is attracted to the suction belt 21 in a state in which the vertical position at which the uppermost sheet P1 floats is regulated. As described above, in the series of the feeding operations illustrated in FIGS. 4A, 4B, 4C, and 4D, the sheet feeding apparatus 200 constantly blows the side air. For this reason, even after the uppermost sheet P1 and the second uppermost sheet P2 are attracted to the suction belt 21, there is an air reservoir between the uppermost sheet P1 and the second uppermost sheet P2, and both sides of the uppermost sheet P1 in the width direction are pressed against the corresponding one of the float regulators 13*b*.

A thick paper has high stiffness. For this reason, the thick paper is unlikely to be deformed in a direction in which a pressing force against the sheet float regulators 13*b* decreases. Thus, the pressing force of the sheet float regulators 13*b* against the uppermost sheet P1 attracted to the suction belt 21 increases.

Further, the thick paper is unlikely to float due to its weight. Accordingly, the air volume of the floating air and the side air may be increased. Accordingly, a floating force of the side air applied to the uppermost sheet P1 attracted to the suction belt 21 increases, and the pressing force of the sheet float regulators 13*b* against the uppermost sheet P1 attracted to the suction belt 21 further increases.

As described above, in the case of the thick paper, the pressing force applied by the sheet float regulators 13*b* to the uppermost sheet P1 attracted to the suction belt 21 is large. For this reason, a feeding load when the suction belt 21 is driven to rotate to feed the uppermost sheet P1 attracted to the suction belt 21 increases. For this reason, a feeding failure such as non-feeding may occur.

Further, in the case of a sheet having an uneven surface such as embossed paper, when the suction belt 21 is rotationally driven to feed the uppermost sheet P1 attracted by the suction belt 21, the uppermost sheet P1 may be caught by the sheet float regulators 13*b*. Accordingly, in the case of the sheet having an uneven surface, the load to feed the sheet is large and non-feeding may occur.

As described above, when the sheet set in the accommodating tray 10 is the thick paper or the embossed paper, preferably the sheet float regulators 13*b* do not regulate the sheet from floating to prevent the feeding failure from occurring.

On the other hand, in the case of a sheet having a small basis weight such as thin paper, the sheet is light. Accordingly, excessive floating may occur. For this reason, unless floating of the sheet is regulated by the sheet float regulators 13*b*, for example, the sheet that floats may climb over the end fence 25 and move upstream in the sheet conveyance direction. Accordingly, the uppermost sheet P1 may not be attracted to the suction belt 21 by a predetermined timing and a feeding failure may occur. Accordingly, when the sheets are sheets of thin paper, the floating sheet needs to be regulated by the sheet float regulators 13*b*.

As described above, depending on the type of the sheet to be accommodated, there is a case in which it is better to regulate the sheet from floating by the float regulator 13*b* and a case in which it is better not to use the float regulator 13*b*. For this reason, in the sheet feeding apparatus 200 according to the present embodiment, each of the sheet float regulators 13*b* is movable between a float regulating position at which the float regulator 13*b* projects from the side fence 13 to regulate the floating position of the sheet and a retracted position at which the float regulator 13*b* is sufficiently retracted inside the side fence 13.

Figure 6:
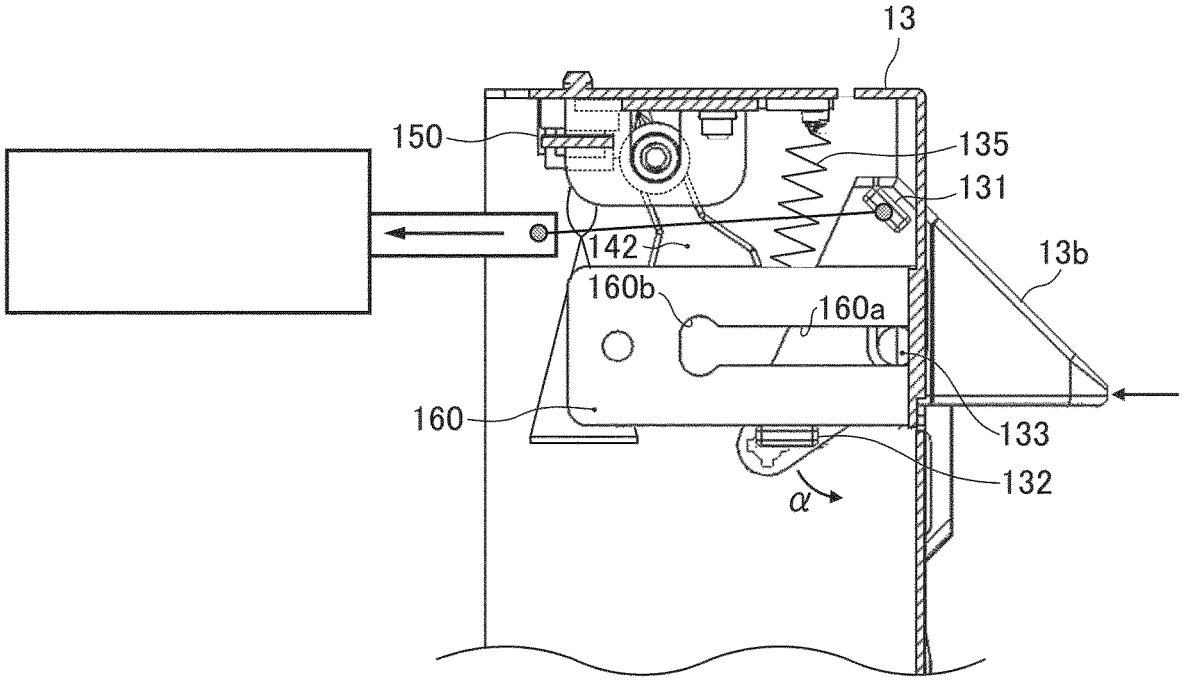
FIG. 6 is a schematic cross-sectional view of a float regulator in a state in which the float regulator is located at a float regulating position, as viewed from an upstream side of the float regulator in a sheet conveyance direction, according to an embodiment of the present disclosure.
Figure 7:
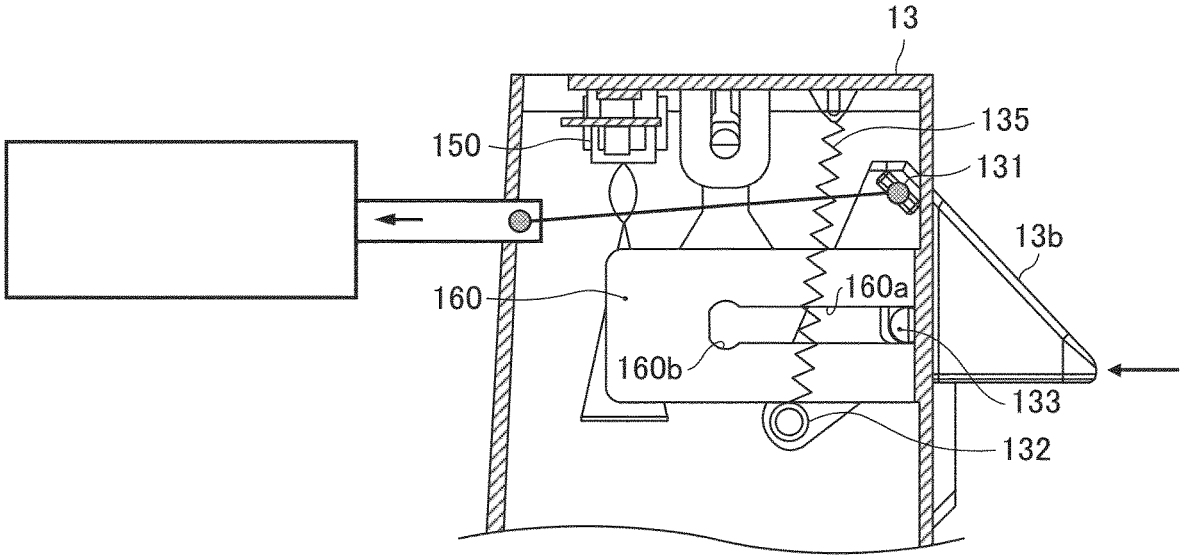
FIG. 7 is a schematic cross-sectional view of the float regulator of FIG. 6 in a state in which the float regulator is located at the float regulating position, as viewed from a downstream side of the float regulator in the sheet conveyance direction.

FIG. 6 is a schematic cross-sectional view of the float regulator 13*b* in a state in which the float regulator 13*b* is located at the float regulating position, as viewed from an upstream side of the float regulator 13*b* in the sheet conveyance direction, according to the present embodiment. FIG. 7 is a schematic cross-sectional view of the float regulator 13*b* in a state in which the float regulator 13*b* is located at the float regulating position, as viewed from a downstream side of the float regulator 13*b* in the sheet conveyance direction, according to the present embodiment.

As illustrated in FIGS. 6 and 7, a support member 160 is disposed inside the side fence 13 to support the float regulator 13*b* such that the float regulator 13*b* is movable between the float regulating position and the retracted position at which the float regulator 13*b* is sufficiently retracted inside the side fence 13. Two of the support members 160 are disposed at an interval in the sheet conveyance direction. FIG. 6 illustrates the support member 160 disposed on an upstream side in the sheet conveyance direction and FIG. 7 illustrates the support member 160 disposed on a downstream side in the sheet conveyance direction. Each of the support members 160 includes an elongated hole 160*a* extending in the width direction of the sheet, i.e., a left-right direction in FIGS. 6 and 7 and an engaging hole 160*b* to hold the float regulator 13*b* at the retracted position.

The engaging hole 160*b* is connected to an end of the elongated hole 160*a* close to an inside of the side fence 13. The length of the engaging hole 160*b* in the vertical direction is longer than the length of the elongated hole 160*a* in the vertical direction.

The float regulator 13*b* includes cylindrical support protrusions 133 on an upstream side surface of the side fence 13 in the sheet conveyance direction and on a downstream side surface of the float regulator 13*b* in the sheet conveyance direction. Each of the cylindrical support protrusions 133 is fitted into the elongated hole 160*a* of the support member 160. Further, the float regulator 13*b* includes a first rotation regulator 131 that contacts an upper end of the support member 160 and restricts a counterclockwise rotation of the float regulator 13*b* in FIG. 6, on the upstream side surface and the downstream side surface of the float regulator 13*b* in the sheet conveyance direction. In addition, the float regulator 13*b* includes a second rotation regulator 132 that contacts the lower end of the support member 160 and restricts the clockwise rotation of the float regulator 13*b* in FIG. 6, on the upstream side surface and the downstream side surface of the float regulator 13*b* in the sheet conveyance direction.

As illustrated in FIG. 6, the second rotation regulator 132 disposed on the downstream side surface of the float regulator 13*b* in the sheet conveyance direction has a quadrangular prism shape. As illustrated in FIG. 7, the second rotation regulator 132 disposed on the downstream side surface of the float regulator 13*b* in the sheet conveyance direction has a columnar shape. One end of a spring 135 is attached to the cylindrical second rotation regulator 132 disposed on the downstream side surface of the float regulator 13*b* in the sheet conveyance direction. When the float regulator 13*b* illustrated in FIGS. 6 and 7 is located at the float regulating position, the float regulator 13*b* is biased clockwise by the spring 135 in FIGS. 6 and 7. Accordingly, the second rotation regulator 132 contacts the lower end of the support member 160 to restrict the rotation of the float regulator 13*b* in the clockwise direction in FIG. 7.

As described later, the first rotation regulator 131 on the downstream side surface of the float regulator 13*b* in the sheet conveyance direction illustrated in FIG. 7 is detected by a detection sensor 150 including a reflective optical sensor when the float regulator 13*b* is located at the retracted position. A push-in member 142 of a releasing mechanism in FIG. 8 releases the float regulator 13*b* located at the retracted position from the retracted position.

Figure 8:
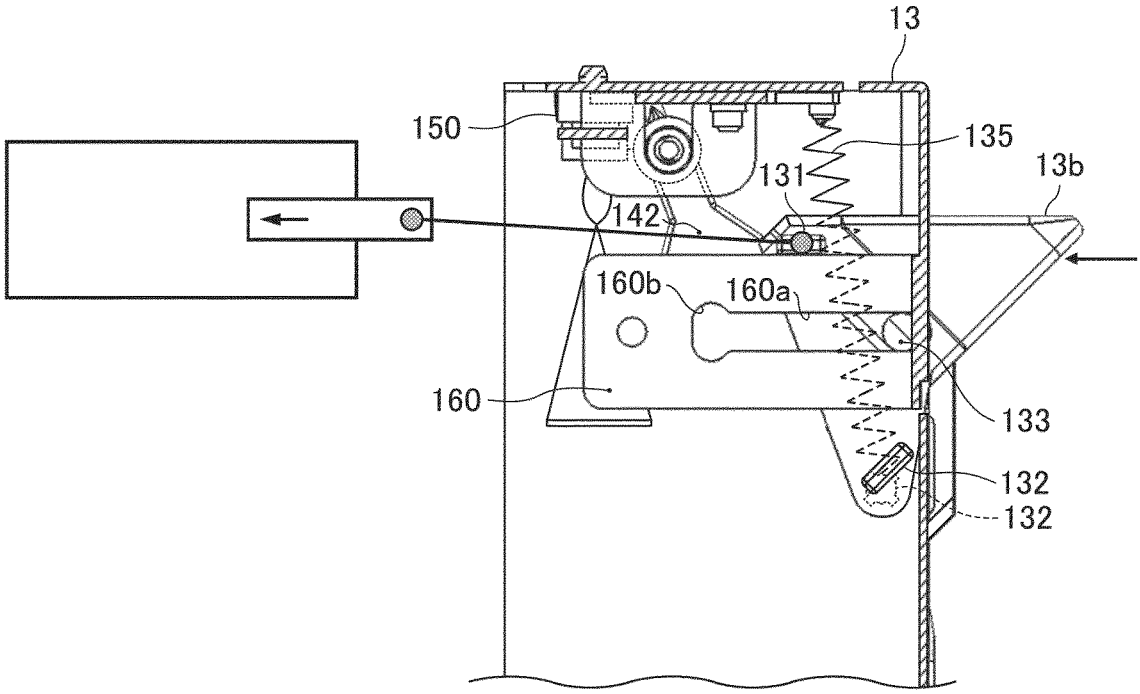
FIG. 8 is a schematic cross-sectional view of the float regulator of FIG. 6 in a state in which the float regulator is in the middle of moving from the float regulating position to a retracted position.
Figure 9:
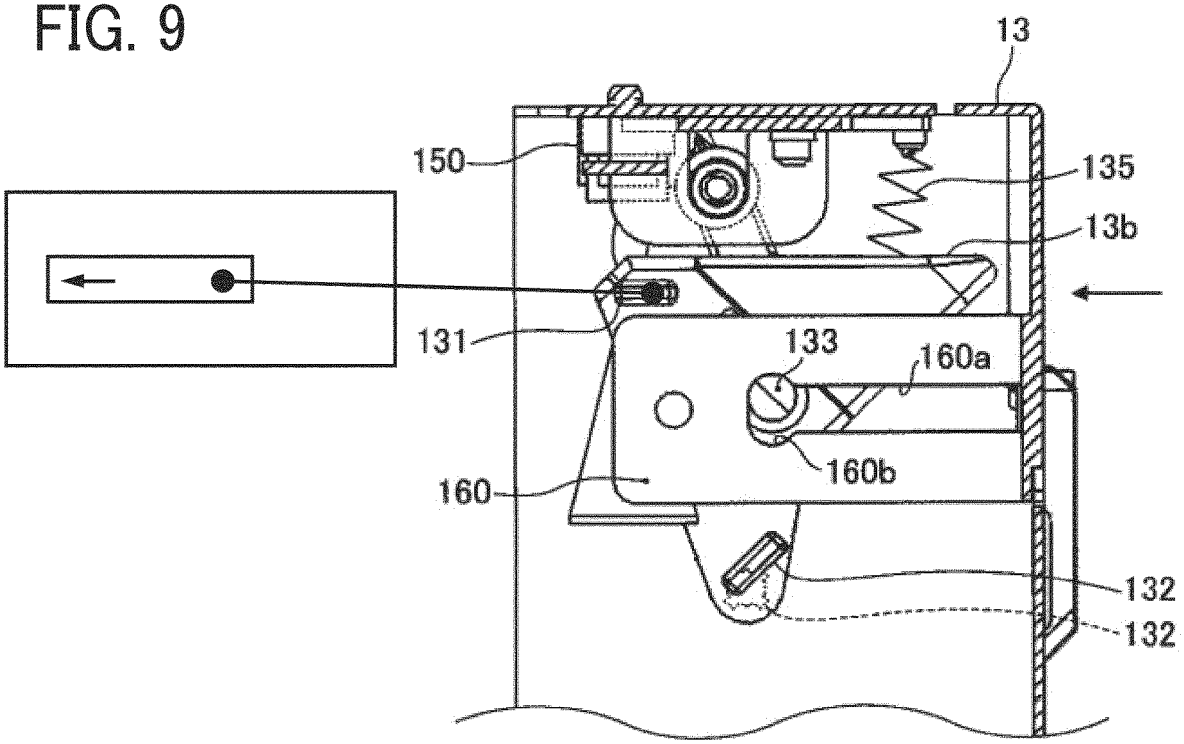
FIG. 9 is a schematic cross-sectional view of the float regulator of FIG. 6 in a state in which the float regulator is located at the retracted position, as viewed from an upstream side of the float regulator in the sheet conveyance direction.

When the float regulator 13*b* is manually pushed toward the side fence 13 as indicated by an arrow in FIGS. 8 and 9, the float regulator 13*b* moves from the float regulating position to the retracted position.

FIG. 8 is a schematic cross-sectional view of the float regulator 13*b* in a state in which the float regulator 13*b* is in the middle of moving from the float regulating position to the retracted position, according to the present embodiment. Note that FIG. 8 is a schematic cross-sectional view of the float regulator 13*b* as viewed from the upstream side of the float regulator 13*b* in the sheet conveyance direction.

When the float regulator 13*b* located at the float regulating position is manually pushed inside the side fence 13, the float regulator 13*b* rotates counterclockwise in FIG. 8 about the support protrusion 133 against the biasing force of the spring 135. Then, as illustrated in FIG. 7, when the first rotation regulator 131 contacts the upper end of the support member 160 and rotation of the float regulator 13*b* in the counterclockwise direction is restricted, the support protrusion 133 moves inside the side fence 13 while being guided by the elongated hole 160*a* of the support member 160. Accordingly, the float regulator 13*b* moves to the retracted position while being guided by the elongated hole 160*a*.

Figure 10:
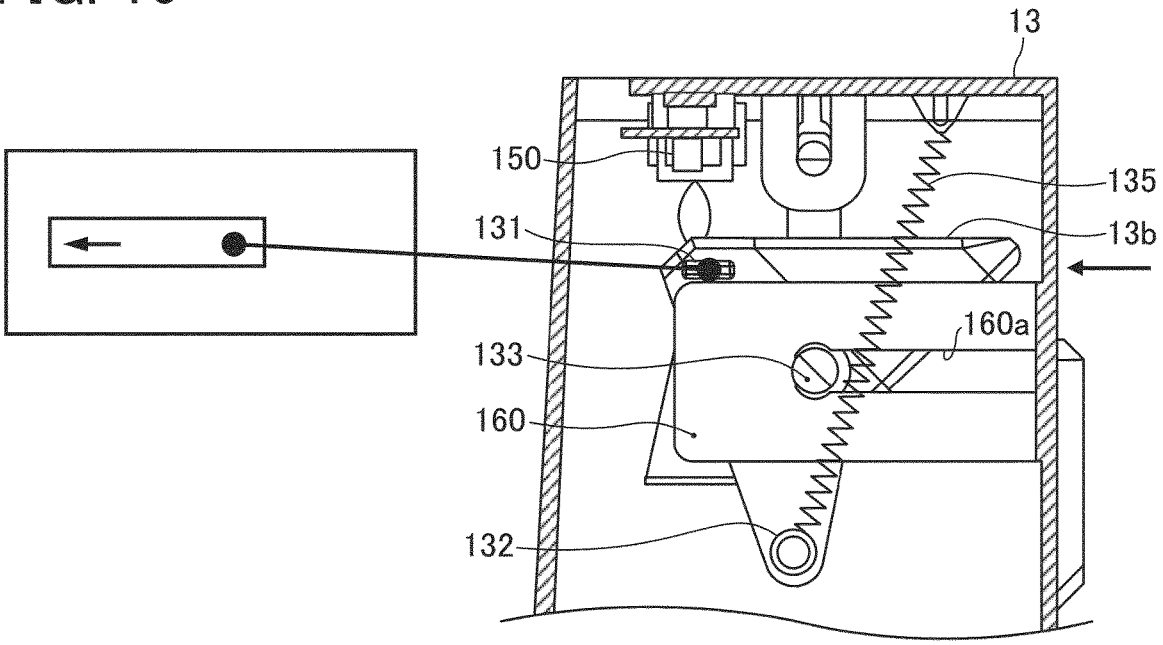
FIG. 10 is a schematic cross-sectional view of the float regulator of FIG. 6 in a state in which the float regulator is located at the retracted position, as viewed from a downstream from the float regulator in the sheet conveyance direction.

FIG. 9 is a schematic cross-sectional view of the float regulator 13*b* in a state in which the float regulator 13*b* is located at the retracted position, as viewed from an upstream side of the float regulator 13*b* in the sheet conveyance direction, according to the present embodiment. Further, FIG. 10 is a schematic cross-sectional view of the float regulator 13*b* in a state in which the float regulator 13*b* is located at the retracted position, as viewed from the downstream side of the float regulator 13*b* in the sheet conveyance direction, according to the present embodiment.

When the float regulator 13*b* is manually pushed inside the side fence 13, the support protrusion 133 of the float regulator 13*b* reaches the engaging hole 160*b*. When the support protrusion 133 reaches the engaging hole 160*b*, the support protrusion 133 is fitted into a recess in the upper portion of the engaging hole 160*b* by the biasing force of the spring 135. Accordingly, the support protrusion 133 engages with the engaging hole 160*b* and the float regulator 13*b* is located at the retracted position.

When the support protrusion 133 is fitted into the recess in the upper portion of the engaging hole 160*b*, the user obtains a click feeling. Thus, the user can grasp that the float regulator 13*b* is located at the retracted position.

When the float regulator 13*b* is located at the retracted position, the support protrusion 133 serving as the rotation fulcrum of the float regulator 13*b* is located on an outer side in the width direction with respect to a line connecting one end and the other end of the spring 135. Accordingly, when the float regulator 13*b* is located at the retracted position, the float regulator 13*b* receives a force to rotate counterclockwise in FIG. 10 by the spring 135. Accordingly, even if the user releases his hand from the float regulator 13*b* after the float regulator 13*b* has reached the retracted position, the float regulator 13*b* continues to maintain the posture in FIG. 8 in which the first rotation regulator 131 contacts the support member 160 and regulates the rotation of float regulator 13*b*.

Note that in the above description, the float regulator 13*b* rotates and then moves toward the retracted position. However, depending on how the user pushes in the float regulator 13*b*, the float regulator 13*b* may rotate after moving to the retracted position. In this case, when the user releases his hand from the float regulator 13*b* after moving the float regulator 13*b* to the retracted position, the biasing force of the spring 135 causes the float regulator 13*b* to automatically rotate counterclockwise in FIG. 10. Then, the first rotation regulator 131 contacts the upper end of the support member 160, and the float regulator 13*b* is located as illustrated in FIGS. 9 and 10.

In the sheet feeding apparatus 200, the float regulator 13*b* is rotated counterclockwise in FIG. 10 from the posture of the float regulating position and is stored in the side fence 13 in a state in which a tip end of the float regulator 13*b* that protrudes in the width direction when the float regulator 13*b* is located at the float regulating position, faces upward. Such an arrangement as described above allows a length of the width of a space for accommodating the float regulator 13*b* in the side fence 13 to be reduced as compared with a case in which the float regulator 13*b* is accommodated in the side fence 13 without being rotated. Accordingly, the length of the side fence 13 in the width direction can be smaller than a case in which the float regulator 13*b* is accommodated in the side fence 13 without being rotated.

Next, the movement of the float regulator 13*b* from the retracted position to the float regulating position is described. The movement of the float regulator 13*b* from the retracted position to the float regulating position is performed by a release mechanism 140.

Figure 11:
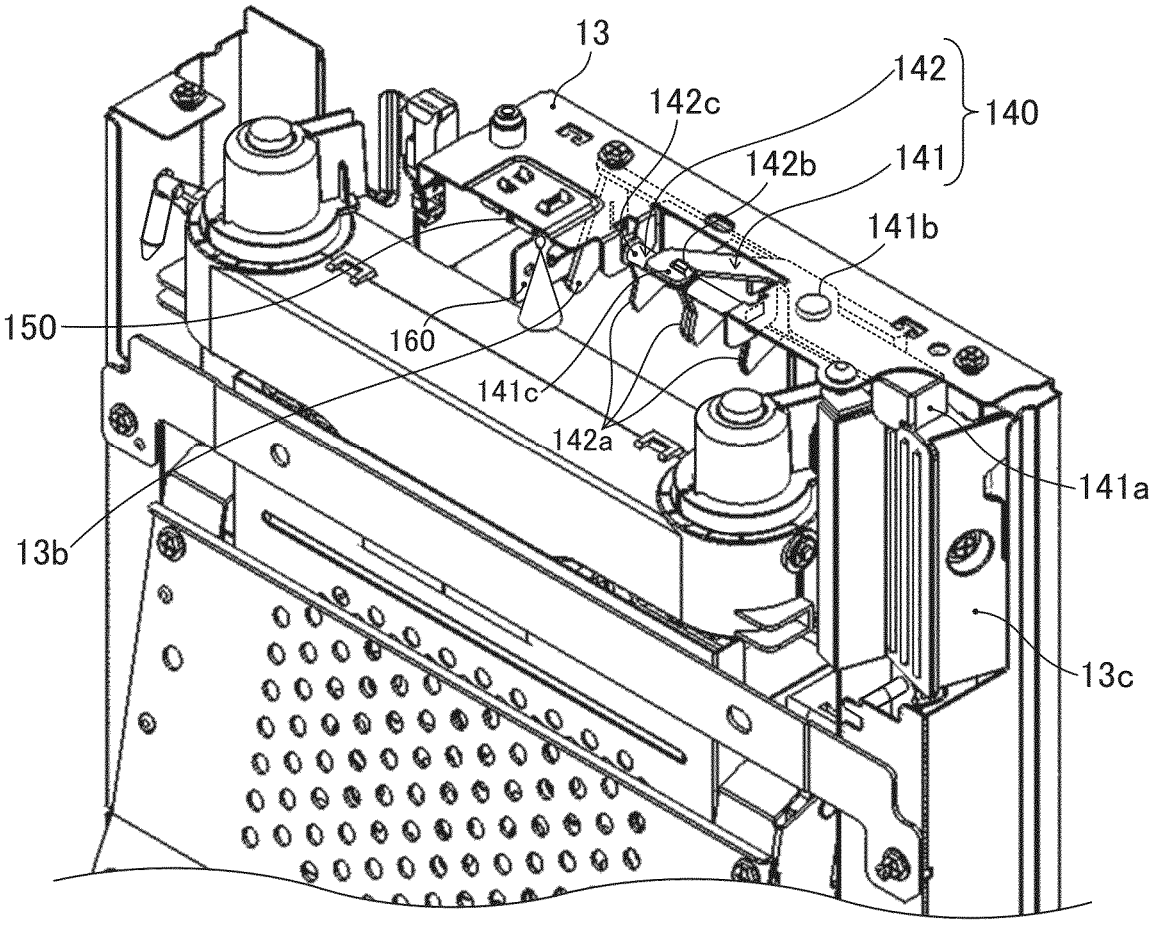
FIG. 11 is a perspective view of a release mechanism provided for the sheet feeding apparatus of FIG. 1, illustrating the structure of the release mechanism according to an embodiment of the present disclosure.

FIG. 11 is a perspective view of the release mechanism 140 provided for the sheet feeding apparatus 200, according to the present embodiment.

The release mechanism 140 includes a release lever 141 and the push-in member 142 that pushes the float regulator 13*b* to the float regulating position.

The release lever 141 includes an operation portion 141*a* to be operated by a user on one end of the release lever 141 and a coupling portion 141*c* coupled with the push-in member 142 on the other end of the release lever 141. A notch is formed in the coupling portion 141*c*, and a coupling protrusion 142*b* of the push-in member 142 is fitted into the notch.

The release lever 141 is swingably attached to a shaft 141*b* disposed on an upper portion of the side fence 13. The operation portion 141*a* is located directly above a release member 13*c* for releasing a lock of the side fence 13.

The push-in member 142 includes a shaft 142*c* rotatably supported by the side fence 13, multiple push-in members 142*a* for pushing in the float regulator 13*b*, and the coupling protrusion 142*b* that is coupled to the release lever 141.

When the float regulator 13*b* is moved from the retracted position to the float regulating position illustrated in FIG. 8, the user pushes the operation portion 141*a* of the release lever 141 inward in the width direction. Then, the release lever 141 swings with the shaft 141*b* as a fulcrum and pushes the coupling protrusion 142*b* of the push-in member 142 outward in the width direction. Subsequently, the push-in member 142 rotates, and the multiple push-in members 142*a* of the push-in member 142 push the float regulator 13*b* located at the retracted position inward in the width direction. When the float regulator 13*b* is pushed by the push-in member 142, the support protrusion 133 of the float regulator 13*b* is disengaged from the engaging hole 160*b*. Then, while the support protrusion 133 is guided by the elongated hole 160*a*, the float regulator 13*b* moves to the float regulating position.

As illustrated in FIGS. 9 and 10, when the support protrusion 133 contacts an inner end portion of the elongated hole 160*a* in the width direction, the biasing force of the spring 135 and the pushing force of the push-in member 142 cause the float regulator 13*b* to rotate clockwise. Thus, and the float regulator 13*b* takes the posture illustrated in FIGS. 6 and 7.

Next, an operation of the detection sensor 150 illustrated in FIGS. 6, 7, 8, 9, 10, and 11 for detecting the float regulator 13*b* is described.

Figure 12A:
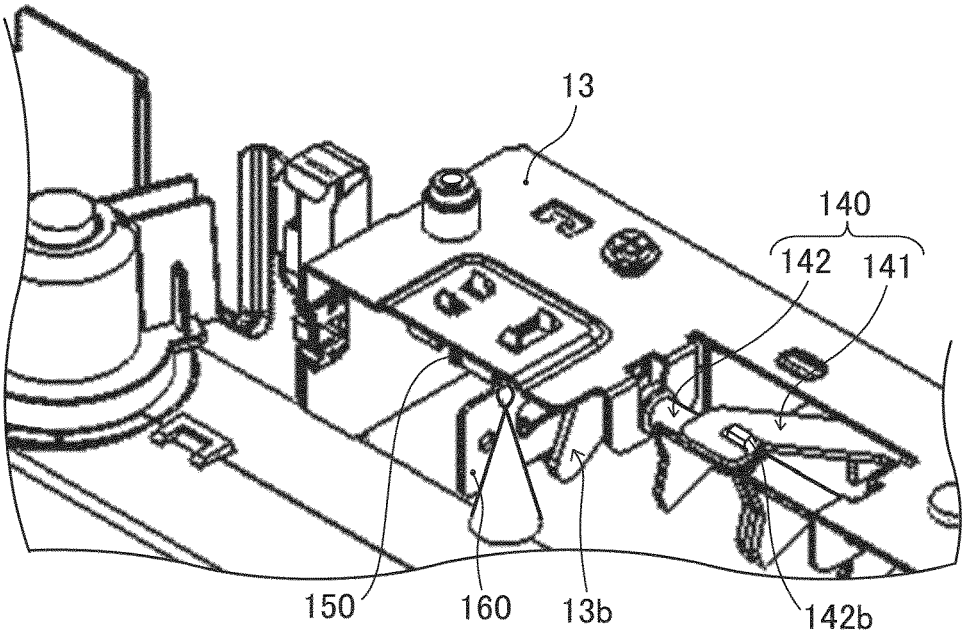
FIGS. 12A and 12B are enlarged perspective views of the vicinity of a detection sensor provided for the sheet feeding apparatus of FIG. 1, according to an embodiment of the present disclosure.
Figure 12B:
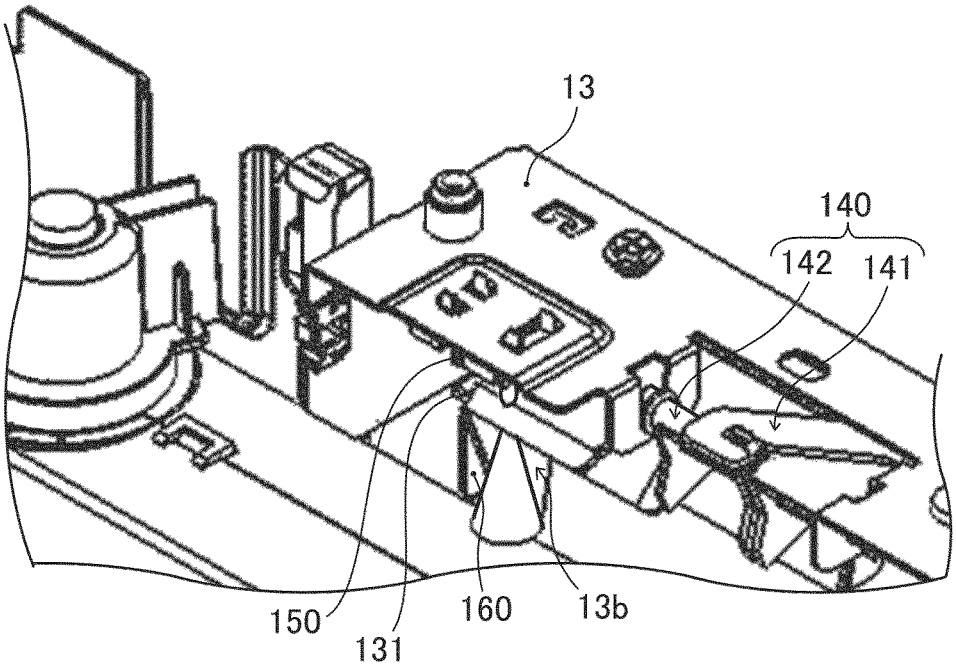

FIGS. 12A and 12B are enlarged perspective views of the vicinity of the detection sensor 150 as a detector according to the present embodiment.

As illustrated in FIG. 12A, when the float regulator 13*b* is located at the float regulating position protruding from the side fence 13, no member is present in a detection range of the detection sensor 150. Accordingly, a light emitted from the detection sensor 150, which is a reflective optical sensor, is not received by a light-receiving element of the detection sensor 150, and the float regulator 13*b* is not detected. Accordingly, when the detection sensor 150 does not detect the float regulator 13*b*, it can be determined that the float regulator 13*b* is located at the float regulating position.

On the other hand, as illustrated in FIG. 12B, when the float regulator 13*b* is located at the retracted position inside the side fence 13, the first rotation regulator 131 on the downstream side in the sheet conveyance direction is located in a detection range of the detection sensor 150. Accordingly, the light receiving element of the detection sensor 150 receives light reflected from the first rotation regulator 131 and detects that the float regulator 13*b* is located at the retracted position.

In the sheet feeding apparatus 200, whether the float regulator 13*b* is located at the retracted position or at the float regulating position when a sheet is fed is set in advance in accordance with the type of sheets to be fed. For example, a table indicating settings as illustrated in FIG. 13 is described in the user manual. The table indicating the settings illustrated in FIG. 13 includes sheet type information (sheet name, sheet type, basis weight category, etc.) and position information (protruding or retracted) of the float regulator 13*b*.

The user refers to the table described in the user manual as illustrated in FIG. 13 and confirms the position of the float regulator 13*b* corresponding to the sheets set on the accommodating tray 10. When the position of the float regulator 13*b* corresponding to the sheets set on the accommodating tray 10 is "protrude", the float regulator 13*b* is set to protrude from the side fence 13 to be located at the float regulating position. On the other hand, when the position of the float regulator 13*b* corresponding to the sheets set in the accommodating tray 10 is "retracted", the float regulator 13*b* is sufficiently retracted inside the side fence 13, and the float regulator 13*b* is located at the retracted position at which floating of the sheet is not regulated.

The basis weight classification indicated in the table of FIG. 13 is as follows.

| | |
|---|---|
| Basis weight 0 | 40.0 to 52.2 g/m$^2$ |
| Basis weight 1 | 52.3 to 63 g/m$^2$ |
| Basis weight 2 | 63.1 to 80 g/m$^2$ |
| Basis weight 3 | 80.1 to 105 g/m$^2$ |
| Basis weight 4 | 105.1 to 163 g/m$^2$ |
| Basis weight 5 | equal to or greater than 163.1 g/m$^2$ |

Note that the above-described basis weight classification is an example and is not limited to the above-described classification. In the sheet feeding apparatus 200 according to the present embodiment, in the case of a sheet having a basis weight 5 or more, the position of the float regulator 13*b* is set to the retracted position. Further, in the case of embossed paper which has a at basis weight 4 or more, the position of the float regulator 13*b* is set to the retracted position.

However, depending on the user, the user may forget to move the float regulator 13*b* based on a setting for the sheets set in the accommodating tray 10 and the position of the float regulator 13*b* may not correspond to the sheets set in the accommodating tray 10. Accordingly, the sheet feeding apparatus 200 determines whether the user has moved the float regulator 13*b* to a position corresponding to the sheets set on the accommodating tray 10. When the float regulator 13*b* is not located at a correct position, the user is prompted to position the float regulator 13*b* at the correct position.

Figure 14:
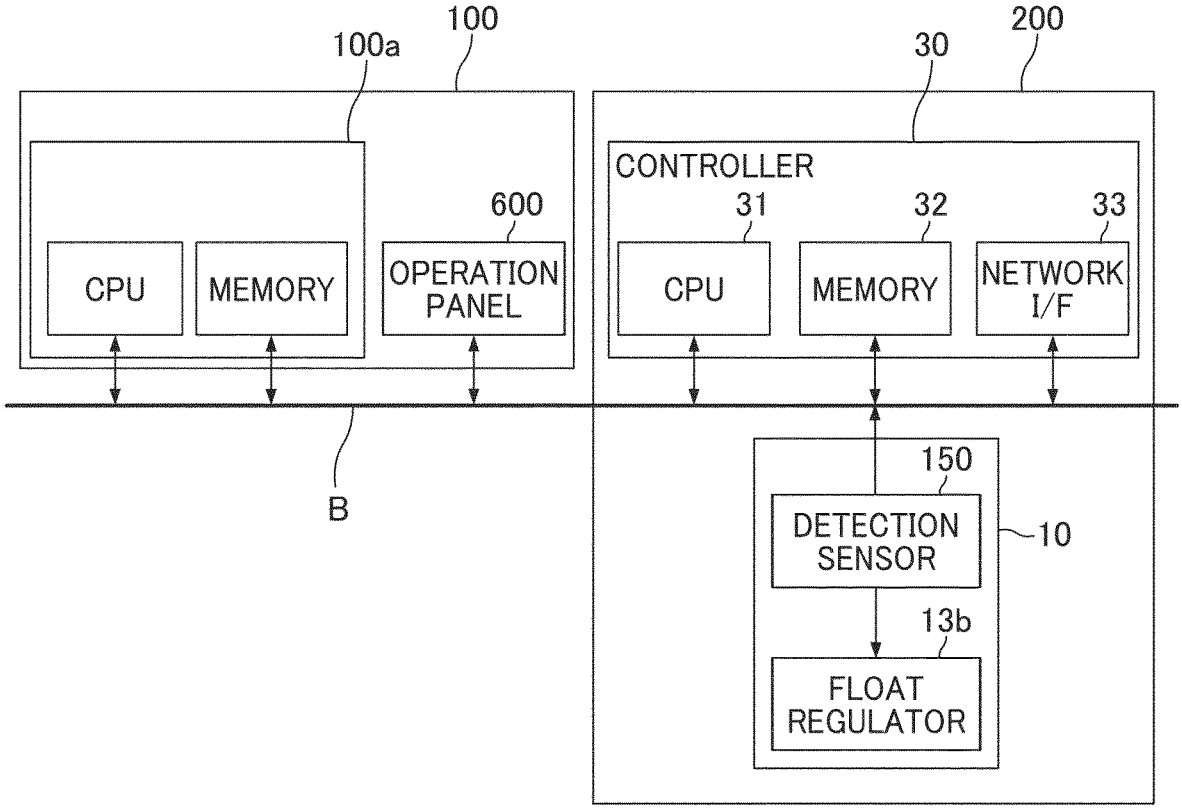
FIG. 14 is a control block diagram of the sheet feeding apparatus of FIG. 1 to determine whether the float regulator is located at a correct position in accordance with a type of sheets, according to an embodiment of the present disclosure.

FIG. 14 is a control block diagram of the sheet feeding apparatus 200 to determine whether the float regulator 13*b* is located at the correct position in accordance with the type of sheets, according to the present embodiment.

In FIG. 14, a controller 30 of the sheet feeding apparatus 200 includes a central processing unit (CPU) 31, a memory 32, and a network interface (I/F) 33. The CPU 31, the memory 32, and the network I/F 33 are each connected to a bus B. The CPU 31 executes a program stored in the memory 32 to control the controller 30. The memory 32 is a nonvolatile memory such as a solid-state drive (SSD) or a hard disk drive (HDD), or a volatile memory such as a dynamic RAM (DRAM). In either case, a program is stored in the memory 32. Further, the memory 32 stores information received from the image forming apparatus body 100 and information held by the sheet feeding apparatus 200 in advance. The network I/F 33 is a communication device for communicating with the image forming apparatus body 100 via a network such as a local area network (LAN) or the Internet.

The memory 32 stores, as the sheet type information, a determination table in which, for example, the sheet name, the sheet category, and the basis weight category indicated in the table of FIG. 13 are associated with the position information of the float regulator 13*b*. The memory 32 stores a notification program for transmitting positional information of the float regulator 13*b* to the image forming apparatus body 100 including the operation panel 600 based on the position of the float regulator 13*b* detected by the detection sensor 150. The CPU 31 executes a notification program and determines whether the float regulator 13*b* is located at a correct position corresponding to sheets to be fed based on the position of the float regulator 13*b* detected by the detection sensor 150. Then, when the float regulator 13*b* is not located at the correct position corresponding to the sheets to be fed, information that the float regulator 13*b* is not located at the correct position corresponding to the sheets to be fed is transmitted to the image forming apparatus body 100. That is, in the present embodiment, the controller 30 functions as a notification device that transmits the position information of the float regulator 13*b* to the notification device.

Figure 15:
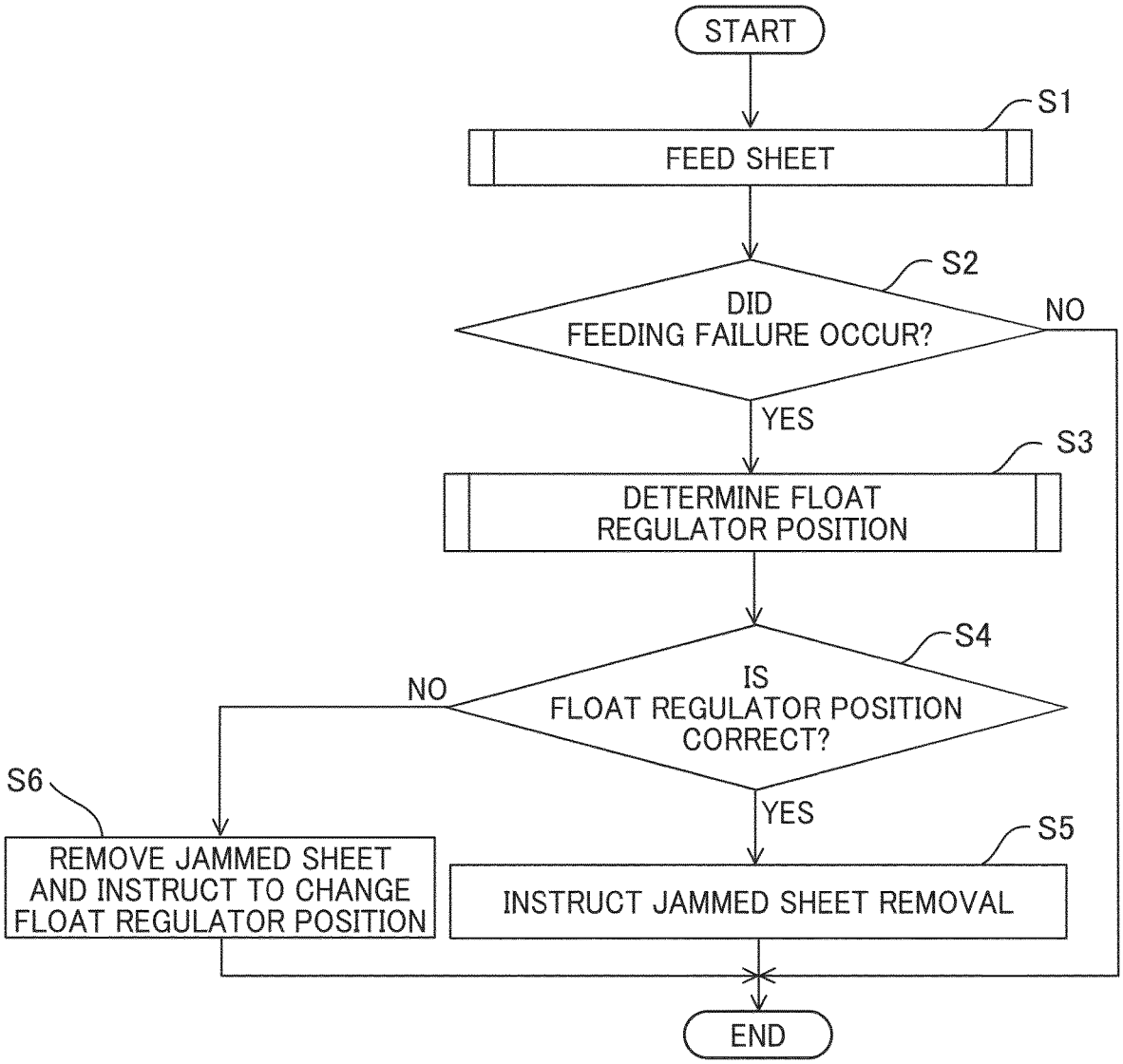
FIG. 15 is a flow chart of transmission of a notification based on position information of a float regulator, according to an embodiment of the present disclosure.

FIG. 15 is a flow chart of transmission of a notification based on a position information of the float regulator 13*b*, according to the present embodiment.

When a sheet feeding instruction is received from a host controller 100*a* of the image forming apparatus body 100, the controller 30 starts a sheet feeding operation (S1). When a feeding failure occurs (YES in S2), the controller 30 determines the position of the float regulator 13*b* (S3).

To be more specific, in addition to the sheet feeding instruction, type information (at least one of the basis weight, the sheet name, and the sheet category) of sheets to be fed is sent from the host controller 100*a* of the image forming apparatus body 100 to the controller 30. The sheet type information is input by a user operating a printer driver installed in a personal computer, for example, and is transmitted to the image forming apparatus body 100 together with a print command. The image forming apparatus body 100 transmits the sheet type information received from the personal computer to the controller 30 of the sheet feeding apparatus 200 together with the sheet feeding instruction.

When the controller 30 executes processing of a float regulator position determination, the controller 30 specifies the position of the float regulator 13*b* based on the sheet type information of the fed sheets received together with the sheet feeding instruction and the determination table stored in the memory 32. For example, in a case in which the basis weight of the sheets to be fed as the sheet type information is basis weight 5 or more of the basis weight classification, the position of the float regulator 13*b* corresponding to the fed sheets is set to be the retracted position. In a case in which the sheet classification as the sheet type information is the embossed paper and the basis weight is basis weight 4 or more of the basis weight classification, the position of the float regulator 13*b* corresponding to the fed sheets is set to be the retracted position". In a case in which the sheet classification is other than the embossed paper and the basis weight is basis weight 4 or smaller, the position of the float regulator 13*b* corresponding to the fed sheets is set to be the float regulating position. Further, in a case in which the sheet classification is the embossed paper and the basis weight is equal to or smaller than basis weight 3, the position of the float regulator 13*b* corresponding to the fed sheets is set to be the float regulating position.

In addition, the controller 30 may specify the basis weight classification and the sheet classification of sheets from the sheet name as the sheet type information and specify the position of the float regulator 13*b* corresponding to the fed sheets.

Next, the controller 30 checks signals from the detection sensor 150 and determines whether the float regulator 13*b* is located at the retracted position or at the float regulating position. When the detection sensor 150 has detected the float regulator 13*b* and transmits a signal (voltage) to the controller 30, the controller 30 determines that the float regulator 13*b* is located at the retracted position. On the other hand, when the detection sensor 150 has not detected the float regulator 13*b* and does not transmit a signal (voltage) to the controller 30, the controller 30 determines that the float regulator 13*b* is located at the float regulating position.

Then, the controller 30 determines whether the position of the float regulator 13*b* specified based on the detection result of the detection sensor 150 is located at a position corresponding to the fed sheets.

When the float regulator 13*b* is located at the position corresponding to the fed sheets (YES in S4), feeding failure is not caused by the float regulator 13*b*. Accordingly, at this time, the controller 30 instructs the image forming apparatus body 100 to display a jam removal instruction on the operation panel 600. The host controller 100*a* of the image forming apparatus body 100 displays the jam removal instruction on a display of the operation panel 600 based on the jam removal instruction received from the sheet feeding apparatus 200.

On the other hand, when the float regulator 13*b* is not located at the position corresponding to the fed sheets (NO in S4), the feeding failure may have been caused by the float regulator 13*b*. For example, in a case in which the fed sheets are sheets of plain paper having basis weight of 4 or smaller and the float regulator 13*b* is located at the retracted position, excessive floating of the sheets may occur and cause a feeding failure. In addition, in a case in which the fed sheets are sheets having basis weight of 5 or more and the float regulator 13*b* is located at the float regulating position, a feeding load may increase. Thus, a feeding failure may have occurred.

Figure 16:
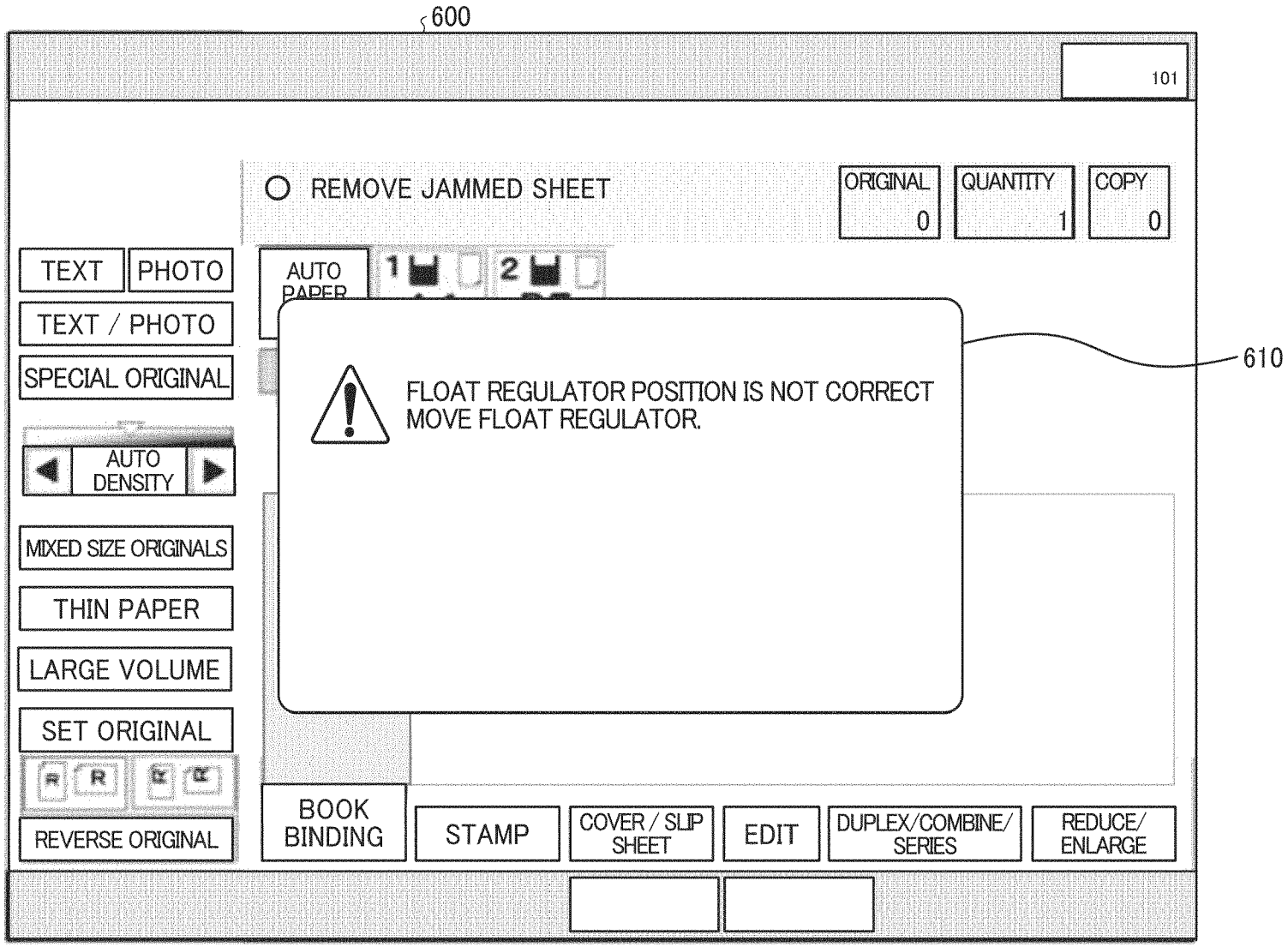
FIG. 16 is a diagram illustrating an operation panel provided for the image forming apparatus of FIG. 1, on which a warning message is displayed when a float regulator is not located at a correct position, according to an embodiment of the present disclosure.

Accordingly, when the float regulator 13*b* is not located at the position corresponding to the fed sheets (NO in S4), the controller 30 transmits information indicating that the float regulator 13*b* is not located at the correct position to the image forming apparatus body 100 and instructs the image forming apparatus body 100 to display a warning message. The host controller 100*a* of the image forming apparatus body 100 displays the jam removal instruction on the display of the operation panel 600 and a warning message that instructs the user to move the float regulator 13*b* to the correct position as illustrated in FIG. 16 based on the information indicating that the float regulator 13*b* is not located at the correct position as the position information of the float regulator 13*b* received from the sheet feeding apparatus 200 (S6).

In addition, the controller 30 may transmit information indicating that the float regulator 13*b* is not located at the correct position to a personal computer that has transmitted a print command to the image forming apparatus body 100, and may display that the float regulator 13*b* is not located at the correct position on a monitor of the personal computer. Further, the sheet feeding apparatus 200 may include a display panel as a notification device and display that the float regulator 13*b* is not located at a correct position.

The user moves the float regulator 13*b* to the correct position based on the warning message displayed on the operation panel 600 for the jam removal. When the detection sensor 150 detects that the float regulator 13*b* has reached the correct position, the warning message on the operation panel 600 is erased and a message indicating that printing is possible is displayed, and sheets are re-fed. Accordingly, when the sheets are re-fed after the jam is removed, a feeding failure caused by the float regulator 13*b* can be prevented from occurring.

Note that depending on, for example, the operating environment, a feeding failure may not occur and the sheets are fed even when the float regulator 13*b* is not located at the correct position corresponding to the sheets to be fed. For this reason, it is troublesome for the user if feeding of sheets cannot be performed unless the user is notified to move the float regulator 13*b* to the correct position when the float regulator 13*b* is not located at the correct position before the feeding operation and the float regulator 13*b* is moved to the correct position.

Accordingly, when a feeding failure occurs, the sheet feeding apparatus 200 determines whether the float regulator 13*b* is located at the correct position corresponding to the sheets to be fed and notifies the user when the float regulator 13*b* is not located at the correct position. For this reason, the user is notified that the float regulator 13*b* is not located at the correct position only when a feeding failure occurs. Thus, stress of the user can be reduced compared to a case in which the user is notified every time when the float regulator 13*b* is not located at the correct position.

Note that a following advantage is obtained by determining whether the float regulator 13*b* is located at the position corresponding to the sheets to be fed before the feeding of the sheets is started, and notifying the user when the float regulator 13*b* is not located at the position corresponding to the sheets to be fed. In other words, the advantage is that the occurrence of a feeding failure caused by the float regulator 13*b* can be reliably prevented.

Further, in the above description, the retracted position of the float regulator 13*b* is a position at which the float regulator 13*b* is sufficiently retracted inside the side fence 13 and the float regulator 13*b* does not regulate the sheets from floating. However, the retracted position may be a partially retracted position at which the float regulator 13*b* is partially retracted into the side fence 13. In a case in which the retracted position is the partially retracted position in which the float regulator 13*b* is partially retracted into the side fence 13, unlike the sufficiently retracted position, a part of the float regulator 13*b* protrudes from the side fence 13 when the float regulator 13*b* is located at the partially retracted position. Accordingly, the float regulator 13*b* regulates the floating position of the sheets. However, the amount of protrusion of the float regulator 13*b* at the partially retracted position from the side fence 13 is smaller than the amount of protrusion of the float regulator 13*b* at the float regulating position. Accordingly, the pressing force of the float regulator 13*b* against the floated sheets is weakened. Accordingly, an increase in sliding resistance of the float regulator 13*b* when stiff sheets such as sheets of thick paper are fed, can be prevented. Accordingly, depending on the configuration of the sheet feeding apparatus 200, the retracted position of the sheet float regulator 13*b* can be set as the partially retracted position to prevent a feeding failure when the basis weight classification is thick paper having a basis weight 5 or more or when the basis weight classification is embossed paper having a basis weight of 4 or more.

Further, for example, when sheets of thick paper having a basis weight classification of basis weight 5 or more, or when sheets of embossed paper having a basis weight classification of basis weight 4 or more, the float regulator 13*b* is positioned at the sufficiently retracted position at which the float regulator 13*b* is sufficiently retracted inside the side fence 13. When sheets having a basis weight classification of basis weight 2 to basis weight 3, the float regulator 13*b* is positioned at the partial retracted position at which a part of the float regulator 13*b* is retracted into the side fence 13. When sheets having a basis weight classification of basis weight equal to 1 or less, the float regulator 13*b* may be positioned at any one of plurality of retracted positions and the float regulating position depending on the type of the sheets. For example, the float regulator 13*b* may be positioned at the float regulating position.

Note that, in the above description, a display such as the operation panel 600 or the monitor of the personal computer is used as the notification device for notifying the user of information indicating that the float regulator 13*b* is not located at the correct position as the position information of the float regulator 13*b*. However, the notification device is not limited to such a display. For example, a sound generation unit such as a speaker may be used as the notification device. As an example of notifying the user that the float regulator 13*b* is not located at the correct position by the sound generation unit, for example, a buzzer, and a voice guidance can be used.

In addition, the image forming apparatus body 100 of the image forming apparatus 1 may be used as a notification device that notifies the user that the float regulator 13*b* is not located at the correct position. In a case in which the image forming apparatus body 100 of the image forming apparatus 1 is used as the notification device, information that the float regulator 13*b* is not located at the correct position is printed on a sheet to notify the user. For example, a sheet may be fed from a feeding unit disposed in the image forming apparatus body 100, and information indicating that the float regulator 13*b* is not located at the correct position may be printed on the sheet. Further, a sheet may be fed from the accommodating tray 10 different from the accommodating tray 10 of the sheet feeding apparatus 200 in which a feeding failure has occurred, and information that the float regulator 13*b* is not located at the correct position may be printed on the sheet. Further, an image forming apparatus that is connected via a network at a remote destination and different from the image forming apparatus 1 according to the present embodiment may be used to print information indicating that the float regulator 13*b* is not located at the correct position.

In the above description, the controller 90 determines whether the float regulator 13*b* is located at the correct position corresponding to the sheets set on the accommodating tray 10 and transmits a determination result to the image forming apparatus body 100 as the position information of the float regulator 13*b*. However, transmitting the determination result is not limited such a configuration. As the position information of the float regulator 13*b*, information that indicates whether the float regulator 13*b* is located at the retracted position or at the float regulating position may be transmitted to the image forming apparatus body 100. For example, when the float regulator 13*b* is located at the float regulating position, information that indicates that the float regulator 13*b* is located at the float regulating position is transmitted to the image forming apparatus body 100 as the position information of the float regulator 13*b*. The image forming apparatus body 100 may display a message, for example, "The float regulator 13*b* is located at the float regulating position. Please check whether the float regulator 13*b* is located at the correct position corresponding to the sheets with the user's manual", together with a jam removal instruction on the display of the operation panel 600.

Further, the image forming apparatus body 100 may determine whether the float regulator 13*b* is located at the correct position corresponding to the sheets based on information indicating whether the float regulator 13*b* is located at the retracted position or at the float regulating position and display the determination result on the display of the operation panel 600.

Further, in the above-described configuration, the user manually moves the float regulator 13*b* between the float regulating position and the retracted position. However, for example, the float regulator 13*b* may be automatically moved between the float regulating position and the retracted position by a driver such as a driving motor.

Such a configuration in which the float regulator 13*b* is automatically moved between the float regulating position and the retracted position by the driver as described above allows the driver to control such that the float regulator 13*b* is automatically moved either to the float regulating position or to the retracted position corresponding to sheets to be fed.

Figure 17:
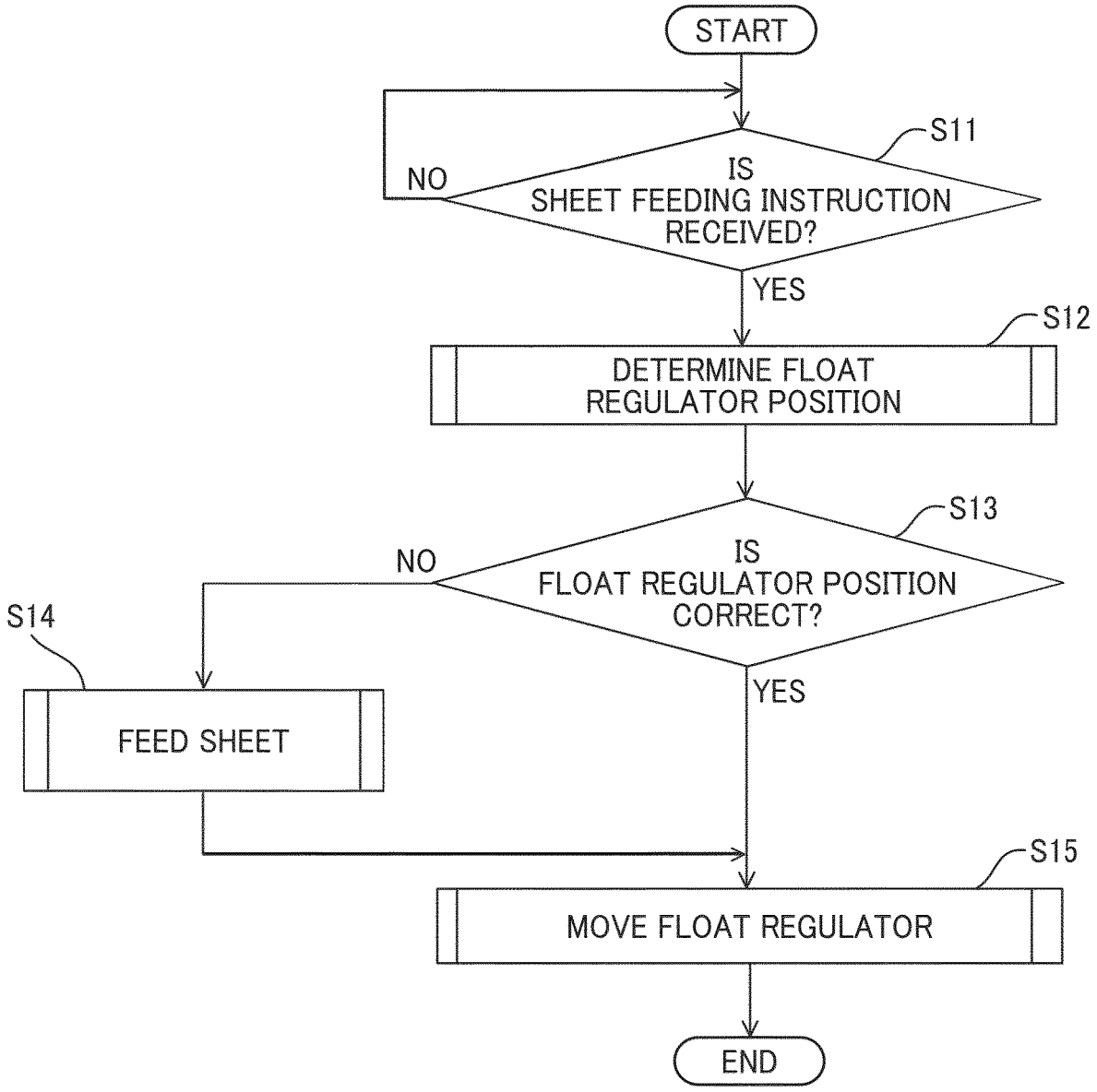
FIG. 17 is a flow chart of control of the movement of a float regulator, according to an embodiment of the present disclosure.

FIG. 17 is a flow chart of control of the movement of the float regulator 13*b*, according to the present embodiment.

When the controller 30 (see FIG. 14) receives a sheet feeding instruction from the host controller 100*a* of the image forming apparatus body 100 (YES in S11), the controller 30 determines the position of the float regulator 13*b* in a similar manner as described above (S12). That is, the position of the float regulator 13*b* corresponding to the sheets to be fed is determined based on the sheet type information such as basis weight and sheet classification received together with the sheet feeding instruction and the determination table stored in the memory 32.

Next, the controller 30 determines whether the float regulator 13*b* is located at a position corresponding to the sheets to be fed based on the detection result of the detection sensor 150 (S13). When the float regulator 13*b* is located at the position corresponding to the sheets to be fed (YES in S13), the feeding failure caused by the float regulator 13*b* is unlikely to occur. Thus, the controller 30 shifts to the feeding operation to feed the sheets (S15).

On the other hand, when the float regulator 13*b* is not located at the position corresponding to the sheets to be fed (NO in S13), a feeding failure caused by the float regulator 13*b* may occur. Accordingly, the controller 30 controls the driver to move the float regulator 13*b* from the position not corresponding to the sheets to be fed to the position corresponding to the sheets to be fed (S14). When the float regulator 13*b* is located at the position corresponding to the sheets to be fed, the feeding operation is started, and the sheets are fed (S15).

In the configuration in which the float regulator 13*b* is automatically moved between the float regulating position and the retracted position by the driver, the float regulator 13*b* can be moved to the correct position corresponding to the sheets to be fed without requiring the user's labor. Accordingly, the feeding operation after positioning the float regulator 13*b* at the position corresponding to the sheets to be fed can be performed. Accordingly, the occurrence of the feeding failure caused by the float regulator 13*b* can be favorably prevented.

In addition, in a configuration in which the float regulator 13*b* is automatically moved by the driver, the retracted position may be set to a partial retracted position at which a part of the float regulator 13*b* is retracted into the side fence 13 depending on the configuration of the image forming apparatus 1.

Further, in the configuration in which the float regulator 13*b* is automatically moved by the driver, for example, in the case of the sheets of thick paper having a basis weight category of basis weight 5 or more or the sheets of embossed paper having a basis weight category of basis weight 4 or more, the float regulator 13*b* is located at the sufficiently retracted position at which the float regulator 13*b* is sufficiently retracted into the side fence 13. When sheets having a basis weight category of basis weight 2 to basis weight 3 are to be fed, the float regulator 13*b* is positioned at the partially retracted position at which the float regulator 13*b* is partially retracted into the side fence 13. When sheets having a basis weight category of a basis weight equal to 1 or less, the float regulator 13*b* may be positioned at any one of the plurality of retracted positions and the float regulating position depending on the type of the sheets to be fed. For example, the float regulator 13*b* may be positioned at the float regulating position.

Note that, in the above description, when the sheets are fed, the sheet type information of the sheets to be fed is received and whether the float regulator 13*b* is positioned at a position corresponding to the sheets to be fed is determined. However, the present disclosure is not limited to such a configuration. For example, when sheets are set in the accommodating tray 10, the user inputs the sheet type information of the sheets set in the accommodating tray 10 such as basis weight and sheet classification through the operation panel 600. Then, when the accommodating tray 10 is set, whether the float regulator 13*b* is located at a position corresponding to the sheets to be fed may be determined. In a case in which the user manually moves the float regulator 13*b*, when the float regulator 13*b* is not located at the correct position, the user may be notified to move the float regulator 13*b* to the correct position when the accommodating tray 10 is set. In addition, information that indicates that the position of the float regulator 13*b* is not correct may be stored in the memory 32. When a feeding failure occurs, the user may be notified to move the float regulator 13*b* to the correct position. On the other hand, in a case in which the float regulator 13*b* is automatically moved, when the float regulator 13*b* is not located at the correct position, the float regulator 13*b* is moved to the correct position when the accommodating tray 10 is set.

The above description is merely an example, and specific effects are exerted for each of the following modes.

First Mode

A sheet feeding apparatus such as the sheet feeding apparatus 200 includes a sheet stacker such as the sheet stacking table 11 that loads sheets, an air blower such as the blower 17 that blows air to the sheets, and a sheet float regulator such as the sheet float regulator 13*b* that regulates a floating position of the sheets. The sheet float regulator is movable between a float regulating position at which the sheet float regulator regulates the floating position of the sheets and a retracted position. The sheet feeding apparatus transmits position information of the sheet float regulator such as information on whether the sheet float regulator is located at the correct position to a notification device such as the operation panel 600.

For example, when sheets stacked on the sheet stacker have a large basis weight, such as thick paper, the sheets have high stiffness. Thus, the sheets contact the float regulator 13*b* strongly. Accordingly, a load for feeding the sheets increases and a feeding failure may occur. Unlike a sheet having a small basis weight such as a sheet of thin paper, a sheet having a large basis weight is less likely to be excessively floated. Accordingly, force of regulating the sheet from floating by the float regulator may be weak. In some cases, regulating the sheet from floating by the float regulator may not be necessary.

On the other hand, in the case of the sheet having a small basis weight such as the sheet of thin paper, unless the float regulator is projected from the side fence to some extent to regulate the sheet from floating, the sheet may be excessively floated and run over the end fence to cause a feeding failure. As described above, depending on the type of sheet, whether the float regulator is necessary and an optimum amount of protrusion of the float regulator from the side fence so as to prevent a feeding failure differ.

In the feeding device disclosed in Japanese Examined Patent Publication No. 22-4522033, the float regulator uniformly regulates floating of any type of sheet. Accordingly, regulating operation of the float regulator may cause a feeding failure depending on the type of sheet such as a sheet having a large basis weight.

In the first mode, based on the position of the sheet float regulator, when the user does not position the float regulator at a position corresponding to the sheets stacked on the sheet stacker, the position information of the float regulator is transmitted to the notification device such as the operation panel 600, and the notification device can notify the user that the float regulator is not located at the correct position. Thus, when the float regulator is not located at the position corresponding to the sheets to be fed, the user can be prompted to operate the float regulator to move the float regulator to the position corresponding to the sheets. Accordingly, for example, feeding of a sheet having a large basis weight at a position at which the float regulator corresponds to thin paper can be prevented. Accordingly, a feeding failure caused by regulating operation of the float regulator can be prevented.

Second Mode

In the first mode, when the feeding failure occurs, the position information of the float regulator is transmitted to the notification device such as the operation panel 600.

Such a configuration as described above allows, as described in the above embodiments, the stress of the user to be reduced as compared with a case in which the user is notified every time when the float regulator such as the float regulator 13*b* is not located at the position corresponding to the type of sheets to be fed.

Third Mode

In the first mode or the second mode, when the float regulator such as the float regulator 13*b* is not located at the position corresponding to the sheets to be fed, the position information of the float regulator is transmitted to the notification device such as the operation panel 600.

Such a configuration as described above allows, as described in the above embodiments, the user to be prompted to operate the float regulator and move the float regulator to the position corresponding to the sheets to be fed when the float regulator such as the float regulator 13*b* is not located at the position corresponding to the sheets.

Fourth Mode

In any one of the first, second, and third modes, when the sheets stacked on a sheet stacker such as the sheet stacking table 11 have a basis weight equal to or greater than a predetermined value and the sheet float regulator such as the sheet float regulator 13*b* is not located at the retracted position, or when the sheets stacked on the sheet stacker have a basis weight smaller than the predetermined value and the sheet float regulator is not located at the float regulating position, the position information of the sheet float regulator is transmitted to the notification device such as the operation panel 600.

Such a configuration as described above allows, as described in the embodiment, preventing the feeding failure caused by the sheet float regulator.

Fifth Mode

The sheet feeding apparatus 200 includes a sheet stacker such as the sheet stacking table 11 for loading sheets, a blower such as the blower 17 for blowing air to the sheets, and a float regulator such as the float regulator 13*b* for regulating the floating position of the sheets. The sheet feeding apparatus 200 includes a driver for moving the float regulator between the float regulating position for regulating the floating position of the sheets and the retracted position and a controller such as the controller 30 that controls the driver to move the float regulator to either one of the retracted position or the float regulating position depending on the type of the sheets stacked on the sheet stacker.

Such a configuration as described above allows, as described with reference to FIG. 17, preventing the feeding failure caused by the sheet float regulator.

Sixth Mode

In the fifth mode, when the basis weight of the sheets stacked on the sheet stacker such as the sheet stacking table 11 is equal to or greater than a predetermined value, if the float regulator such as the float regulator 13*b* is not located at the retracted position, the float regulator is moved to the retracted position. When the basis weight of the sheets stacked on the sheet stacker such as the sheet stacking table 11 is smaller than the predetermined value, if the float regulator is not located at the float regulating position, the float regulator is moved to the float regulating position.

Such a configuration as described above allows preventing the feeding failure caused by the float regulator such as the float regulator 13*b*.

Seventh Mode

In any one of the first mode to sixth mode, the sheet feeding apparatus 200 includes a detector such as the detection sensor 150 that detects the position of the float regulator such as the float regulator 13*b*.

Such a configuration as described above allows determining whether the float regulator such as the float regulator 13*b* is located at the position corresponding to the type of the sheets stacked on the sheet stacker such as the sheet stacking table 11 based on the detection result of the detector such as the detection sensor 150.

Eighth Mode

An image forming apparatus that forms an image on a sheet fed by a feeding device includes the sheet feeding apparatus according to any one of the first mode to seventh mode as the sheet feeding apparatus.

Such a configuration as described above allows preventing the occurrence of a feeding failure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A sheet feeding apparatus comprising:

a sheet stacker configured to stack sheets in a sheet bundle;

an air blower configured to blow air to the sheets;

a side fence configured to regulate a position of the sheet bundle in a width direction of the sheet bundle;

a float regulator configured to regulate a floating position of the sheets, the float regulator being movable between a float regulating position and a retracted position, the float regulator protruding from the side fence toward a center of the sheet bundle in the width direction when in the float regulating position, and the float regulator being retracted inside the side fence when in the retracted position; and a controller configured to transmit position information of the float regulator to a notification device.

2. The sheet feeding apparatus according to claim 1, wherein the controller is configured to transmit the position information of the float regulator to the notification device based on occurrence of a feeding failure.

3. The sheet feeding apparatus according to claim 1, wherein the controller is configured to transmit the position information of the float regulator to the notification device based on the float regulator not being located at a position corresponding to the sheets.

4. The sheet feeding apparatus according to claim 1, wherein the controller is configured to transmit the position information of the float regulator to the notification device based on:

the sheets stacked on the sheet stacker having a basis weight equal to or greater than a first value and the float regulator not being located at the retracted position, or the sheets stacked on the sheet stacker having a basis weight smaller than the first value and the float regulator not being located at the float regulating position.

5. The sheet feeding apparatus according to claim 1, further comprising a detector configured to detect a position of the float regulator.

6. An image forming apparatus configured to form an image on a sheet, the image forming apparatus comprising the sheet feeding apparatus according to claim 1 configured to feed the sheet.

7. The sheet feeding apparatus according to claim 1, wherein the controller is configured to transmit the position information of the float regulator to the notification device based on the float regulator not being located at a first position corresponding to a type of the sheets, the first position being one of the float regulating position or the retracted position.

8. The sheet feeding apparatus according to claim 1, wherein the notification device is configured to output a notification to a user, the notification instructing the user to move the float regulator between the float regulating position and the retracted position.

9. The sheet feeding apparatus according to claim 1, wherein the float regulator is movable between the float regulating position, the retracted position and a partially retracted position, an amount by which the float regulator protrudes from the side fence towards the center of the sheet bundle when in the partially retracted position being less than that by which the float regulator protrudes from the side fence towards the center of the sheet bundle when in the float regulating position.

10. The sheet feeding apparatus according to claim 9, wherein the controller is configured to transmit the position information of the float regulator to the notification device based on the float regulator not being located at a first position corresponding to a type of the sheets, the first position being one of the float regulating position, the retracted position or the partially retracted position.

11. The sheet feeding apparatus according to claim 1, wherein the float regulator is configured to move away from the center of the sheet bundle in the width direction when moving from the float regulating position to the retracted position.

12. The sheet feeding apparatus according to claim 1, wherein the float regulator is configured to rotate when moving between the float regulating position to the retracted position.

13. A sheet feeding apparatus comprising:

a sheet stacker configured to stack sheets in a sheet bundle;

an air blower configured to blow air to the sheets;

a side fence configured to regulate a position of the sheet bundle in a width direction of the sheet bundle;

a float regulator configured to regulate a floating position of the sheets; and a controller configured to cause the float regulator to moves between a float regulating position and a retracted position, the float regulator protruding from the side fence toward a center of the sheet bundle in the width direction when in the float regulating position, the float regulator being retracted inside the side fence when in the retracted position, the controller being configured to cause the float regulator to move to one of the retracted position or the float regulating position based on a type of the sheets stacked on the sheet stacker.

14. The sheet feeding apparatus according to claim 13, wherein the controller is configured to:

cause the float regulator to move to the retracted position based on a basis weight of the sheets stacked on the sheet stacker being equal to or greater than a first value and the float regulator not being located at the retracted position; and cause the float regulator to move to the float regulating position based on the basis weight of the sheets stacked on the sheet stacker being smaller than the first value and the float regulator not being located at the float regulating position.

15. The sheet feeding apparatus according to claim 13, wherein the controller is configured to cause a motor to move the float regulator between the float regulating position and the retracted position.

16. The sheet feeding apparatus according to claim 13, wherein the controller is configured to cause the float regulator to move between the float regulating position, the retracted position and a partially retracted position, an amount by which the float regulator protrudes from the side fence towards the center of the sheet bundle when in the partially retracted position being less than that by which the float regulator protrudes from the side fence towards the center of the sheet bundle when in the float regulating position.

17. The sheet feeding apparatus according to claim 16, wherein the controller is configured to cause the float regulator to move to one of the float regulating position, the retracted position or the partially retracted position based on the type of the sheets stacked on the sheet stacker.

18. The sheet feeding apparatus according to claim 13, wherein the float regulator is configured to move away from the center of the sheet bundle in the width direction when moving from the float regulating position to the retracted position.

19. The sheet feeding apparatus according to claim 13, wherein the float regulator is configured to rotate when moving between the float regulating position to the retracted position.

20. The sheet feeding apparatus according to claim 13, wherein the controller is configured to cause the float regulator to move to one of the retracted position or the float regulating position based on the float regulator not being located at a first position corresponding to the type of the sheets, the first position being one of the float regulating position or the retracted position.

* * * * *